US010642210B2

(12) United States Patent
Shinohara et al.

(10) Patent No.: US 10,642,210 B2
(45) Date of Patent: May 5, 2020

(54) IMAGE FORMING APPARATUS

(71) Applicant: CANON KABUSHIKI KAISHA, Tokyo (JP)

(72) Inventors: Taku Shinohara, Saitama (JP); Yuichiro Shibuya, Abiko (JP); Masaki Kawanishi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 206 days.

(21) Appl. No.: 15/730,114

(22) Filed: Oct. 11, 2017

(65) Prior Publication Data

US 2018/0107146 A1 Apr. 19, 2018

(30) Foreign Application Priority Data

Oct. 17, 2016 (JP) ..... 2016-203394
Sep. 8, 2017 (JP) ..... 2017-173438

(51) Int. Cl.
*G03G 15/00* (2006.01)
*G03G 7/00* (2006.01)

(52) U.S. Cl.
CPC ..... *G03G 15/607* (2013.01); *G03G 7/00* (2013.01); *G03G 15/5016* (2013.01); *G03G 15/5029* (2013.01); *G03G 15/6508* (2013.01); *G03G 15/6514* (2013.01); *G03G 15/6552* (2013.01); *G03G 15/6594* (2013.01); *B65H 2301/33* (2013.01); *G03G 15/5095* (2013.01); *G03G 2215/00358* (2013.01); *G03G 2215/00734* (2013.01); *G03G 2215/0458* (2013.01)

(58) Field of Classification Search
CPC .... G03G 15/607; G03G 7/00; G03G 15/5016; G03G 2215/00358; G03G 2215/00734; G03G 2215/0458; B65H 2301/33
See application file for complete search history.

(56) References Cited

U.S. PATENT DOCUMENTS 6,816,271 B1 * 11/2004 Takahashi ..... G06F 3/1206 358/1.1
7,057,748 B2 * 6/2006 Takahashi ..... G06F 3/1206 358/1.13
9,122,975 B2 * 9/2015 Inui ..... G06K 15/1809
(Continued)

FOREIGN PATENT DOCUMENTS

JP 2015003476 A 1/2015
JP 2016047602 A 4/2016

OTHER PUBLICATIONS

U.S. Appl. No. 15/787,348, filed Oct. 18, 2017, Inventor: Yuichiro Shibuya et al.

*Primary Examiner* — David H Banh
(74) *Attorney, Agent, or Firm* — Venable LLP

(57) ABSTRACT

An image forming apparatus executes an image forming operation adequately while reducing a cumbersome work of a user of setting the sheet size. A processor of the image forming apparatus controls an image forming portion to form the image on the sheet even if the sheet size included in an image forming job is inconsistent with the sheet size stored in a storage portion. In such a mode, the processor controls a notification portion so as to give notification when a size detection portion detects one of regular sheet sizes and where the sheet size included in the image forming job is inconsistent with the detected sheet size.

24 Claims, 21 Drawing Sheets

(56) References Cited

U.S. PATENT DOCUMENTS

| | | | | |
|---|---|---|---|---|
| 9,280,112 | B2 * | 3/2016 | Akimoto | G03G 15/502 |
| 9,415,613 | B2 | 8/2016 | Inui et al. | |
| 9,475,663 | B2 * | 10/2016 | Takata | G03G 15/502 |
| 10,209,929 | B2 * | 2/2019 | Takahashi | G06F 3/1204 |
| 2002/0051182 | A1 * | 5/2002 | Sommer | H04N 1/00408 358/1.15 |
| 2015/0055175 | A1 * | 2/2015 | Iida | G06K 15/1823 358/1.15 |
| 2016/0004939 | A1 * | 1/2016 | Inoue | G06K 15/1809 358/1.12 |

* cited by examiner

FIG.4

| GUIDE WIDTH SENSOR 54 (mm) \ LENGTH DETECTION SENSOR | SENSOR 57 | SENSOR 58 | REGULAR/ IRREGULAR | |
|---|---|---|---|---|
| 140±5 | × | × | REGULAR (A5 HORIZONTAL) | 71 |
| | × | ○ | - | 72 |
| | ○ | × | IRREGULAR | 73 |
| | ○ | ○ | IRREGULAR | |
| 182±5 | × | × | IRREGULAR | |
| | × | ○ | - | |
| | ○ | × | REGULAR (B5 HORIZONTAL) | 74 |
| | ○ | ○ | IRREGULAR | |
| 210±5 | × | × | REGULAR (A5 VERTICAL) | 75 |
| | × | ○ | - | |
| | ○ | × | REGULAR (A4 HORIZONTAL) | 76 |
| | ○ | ○ | IRREGULAR | |
| 257±5 | × | × | REGULAR (B5 VERTICAL) | 77 |
| | × | ○ | - | |
| | ○ | × | IRREGULAR | |
| | ○ | ○ | REGULAR (B4 HORIZONTAL) | 78 |
| 297±5 | × | × | IRREGULAR | |
| | × | ○ | - | |
| | ○ | × | REGULAR (A4 HORIZONTAL) | 79 |
| | ○ | ○ | REGULAR (A3) | 80 |
| SIZE OTHER THAN THOSE DESCRIBED ABOVE | × | × | IRREGULAR | |
| | × | ○ | - | |
| | ○ | × | IRREGULAR | |
| | ○ | ○ | IRREGULAR | |

IMAGE FORMING APPARATUS

BACKGROUND OF THE INVENTION

Field of the Invention

The present disclosure relates to an image forming apparatus configured to form an image on a sheet and to a control method for controlling the image forming apparatus.

Description of the Related Art

An image forming apparatus includes a sheet feed cassette, a manual feed tray and others as a sheet support portion configured to support a sheet, i.e., a recording medium. A control unit of the image forming apparatus recognizes attributes of the sheet placed on the sheet support portion, e.g., a sheet size, a sheet orientation and a sheet type, set by a user through an operation portion of the image forming apparatus for example. Then, in a case where an image forming job is inputted, normally the control unit executes the image forming job after determining whether the sheet attribute information specified by the image forming job conforms to sheet attribute information set concerning to the sheet support portion.

An image forming apparatus is known to be configured to perform different printing operations corresponding to a sheet placed on the sheet support portion. Specifically, the image forming apparatus rotates an orientation of an image to be printed corresponding to the size and orientation of the sheet and changes fixing temperature, fixing pressure and a sheet conveyance speed in fixing the image corresponding to the sheet type for example.

Japanese Patent Application Laid-open No. 2015-3476 discloses an image forming apparatus which enables to omit re-setting of sheet information such as a sheet size in terms of the manual feed tray in a case where sheets run short while executing the image forming job. This image forming apparatus is configured to relieve an operational burden of the user such that the user needs not to set the sheet information again in replenishing an insufficient sheet.

By the way, the image forming job includes a PDL job described in Page Description Language (referred to as a 'PDL' hereinafter) and transmitted from a host computer to the image forming apparatus. However, in a case where the PDL job is inputted into the image forming apparatus, the user needs to carry out both operations of setting sheet attribute information through driver software and sheet attribute information through the operation portion of the image forming apparatus.

Then, not only the arrangement which allows the input of the sheet attribute information to be omitted only when the sheets run short as described in the abovementioned document, but it is also conceivable to provide a mode of executing the job by preferentially using the sheet attribute information included in the PDL job in a case of the PDL job. It is possible to expect to relieve the operational burden of the user in executing the PDL job because the setting operation otherwise conducted through the operation portion can be omitted when such mode is adopted.

However, there may be a case where an output image expected by the user cannot be obtained if the sheet attribute information included in the PDL job is evenly used in all cases. That is, there is a case where a sheet size included in the PDL job is different from a size of the sheet placed on the sheet support portion in a case where the user erroneously places a sheet of a different size on the manual feed tray or erroneously performs a sheet size setting operation through driver software. In this case, an image to be formed on the sheet may be cut on a way or jam may occur, thus halting the image forming apparatus.

The present disclosure provides an image forming apparatus configured to execute an image forming operation adequately while reducing a cumbersome work of a user of setting the sheet size and a control method for controlling the image forming apparatus.

SUMMARY OF THE INVENTION

According to a first aspect of the present invention, am image forming apparatus includes a sheet support portion configured to support a sheet, an image forming portion configured to form an image on the sheet fed from the sheet support portion, a storage portion configured to store information concerning a sheet size which is inputted through an operation portion associated with the sheet support portion, a notification portion configured to give notification, a size detection portion configured to detect a sheet size of the sheet supported on the sheet support portion, and a processor configured to execute one of a plurality of modes including a first mode and a second mode in a case where an image forming job is inputted. The first mode is a mode where the processor controls the image forming portion to form an image on the sheet only if a sheet size included in the image forming job is consistent with the sheet size stored in the storage portion. The second mode is a mode where the processor is capable of controlling the image forming portion to form the image on the sheet even if the sheet size included in the image forming job is inconsistent with the sheet size stored in the storage portion. The processor controls, in the second mode, the image forming portion so as to form the image on the sheet in a case where the size detection portion detects one of regular sheet sizes and where the sheet size included in the image forming job is consistent with the sheet size detected by the size detection portion, and controls, in the second mode, the notification portion so as to give notification in a case where the size detection portion detects one of regular sheet sizes and where the sheet size included in the image forming job is inconsistent with the sheet size detected by the size detection portion.

According to a second aspect of the present invention, am image forming apparatus includes a sheet support portion configured to support a sheet, an image forming portion configured to form an image on the sheet fed from the sheet support portion, a storage portion configured to store information concerning a sheet size which is inputted through an operation portion associated with the sheet support portion, a notification portion configured to give notification, a size detection portion configured to detect a sheet size of the sheet supported on the sheet support portion, and a processor configured to execute one of a plurality of modes including a first mode and a second mode in a case where an image forming job is inputted. The first mode is a mode where the processor controls the image forming portion to form an image on the sheet only if a sheet size included in the image forming job is consistent with the sheet size stored in the storage portion. The second mode is a mode where the processor is capable of controlling the image forming portion to form the image on the sheet even if the sheet size included in the image forming job is inconsistent with the sheet size stored in the storage portion. The processor controls, in the second mode, the image forming portion so as to form an image on the sheet in a case where the size detection portion detects one of regular sheet sizes and where the sheet size included in the image forming job is less than or equal to the sheet size detected by the size detection portion, and controls, in the second mode, the notification portion so as to give notification in a case where the size detection portion detects one of regular sheet sizes and where the sheet size included in the image forming job is larger than the sheet size detected by the size detection portion.

According to a third aspect of the present invention, am image forming apparatus includes a sheet support portion configured to support a sheet, an image forming portion configured to form an image on the sheet fed from the sheet support portion, a sheet conveyance portion configured to convey the sheet, a storage portion configured to store information concerning a sheet size which is inputted through an operation portion associated with the sheet support portion, a size detection portion configured to detect a sheet size of the sheet supported on the sheet support portion, and a processor configured to execute one of a plurality of modes including a first mode and a second mode in a case where an image forming job is inputted. The first mode is a mode where the processor controls the image forming portion to form an image on the sheet only if a sheet size included in the image forming job is consistent with the sheet size stored in the storage portion. The second mode is a mode where the processor is capable of controlling the image forming portion to form the image on the sheet even if the sheet size included in the image forming job is inconsistent with the sheet size stored in the storage portion. The processor controls, in the second mode, the image forming portion so as to form an image on the sheet in a case where the size detection portion detects one of regular sheet sizes and where the sheet size included in the image forming job is consistent with the sheet size detected by the size detection portion, and the processor controls, in the second mode, a conveyance operation by the sheet conveyance portion corresponding to the sheet size detected by the size detection portion and controls the image forming portion to form an image on the sheet in a case where the size detection portion detects one of regular sheet sizes and where the sheet size included in the image forming job is inconsistent with the sheet size detected by the size detection portion.

According to a fourth aspect of the present invention, am image forming apparatus includes a sheet support portion configured to support a sheet, an image forming portion configured to form an image on the sheet fed from the sheet support portion, a sheet conveyance portion configured to convey the sheet, a storage portion configured to store information concerning a sheet size which is inputted through an operation portion associated with the sheet support portion, a size detection portion configured to detect a sheet size of the sheet supported on the sheet support portion, and a processor configured to execute one of a plurality of modes including a first mode and a second mode in a case where an image forming job is inputted. The first mode is a mode where the processor controls the image forming portion to form an image on the sheet only if a sheet size included in the image forming job is consistent with the sheet size stored in the storage portion. The second mode is a mode where the processor is capable of controlling the image forming portion to form the image on the sheet even if the sheet size included in the image forming job is inconsistent with the sheet size stored in the storage portion. The processor controls, in the second mode, the image forming portion so as to form an image on the sheet in a case where the size detection portion detects one of regular sheet sizes and where the sheet size included in the image forming job is consistent with the sheet size detected by the size detection portion, and the processor controls, in the second mode, a conveyance operation by the sheet conveyance portion corresponding to a maximum sheet size supported by the image forming apparatus and controls the image forming portion to form an image on the sheet in a case where the size detection portion detects one of regular sheet sizes and where the sheet size included in the image forming job is inconsistent with the sheet size detected by the size detection portion.

According to a fifth aspect of the present invention, am image forming apparatus includes a sheet support portion configured to support a sheet, an image forming portion configured to form an image on the sheet fed from the sheet support portion, a sheet conveyance portion configured to convey the sheet, a storage portion configured to store information concerning a sheet size which is inputted through an operation portion associated with the sheet support portion, and a processor configured to execute one of a plurality of modes including a first mode and a second mode in a case where an image forming job is inputted. The first mode is a mode where the processor controls the image forming portion to form an image on the sheet only if a sheet size included in the image forming job is consistent with the sheet size stored in the storage portion. The second mode is a mode where the processor is capable of controlling the image forming portion to form the image on the sheet even if the sheet size included in the image forming job is inconsistent with the sheet size stored in the storage portion. The processor controls, in the second mode, the image forming portion so as to form an image on the sheet in a case where the sheet size included in the image forming job is consistent with the sheet size stored in the storage portion, and the processor controls, in the second mode, a conveyance operation by the sheet conveyance portion corresponding to a maximum sheet size supported by the image forming apparatus and controls the image forming portion to form an image on the sheet in a case where the sheet size included in the image forming job is inconsistent with the sheet size stored in the storage portion.

Further features of the present invention will become apparent from the following description of exemplary embodiments with reference to the attached drawings.

BRIEF DESCRIPTION OF THE DRAWINGS

FIG. 4 is a table illustrating size determination judgment of an automatic size detecting function.

DESCRIPTION OF THE EMBODIMENTS

First Embodiment

Figure 1:
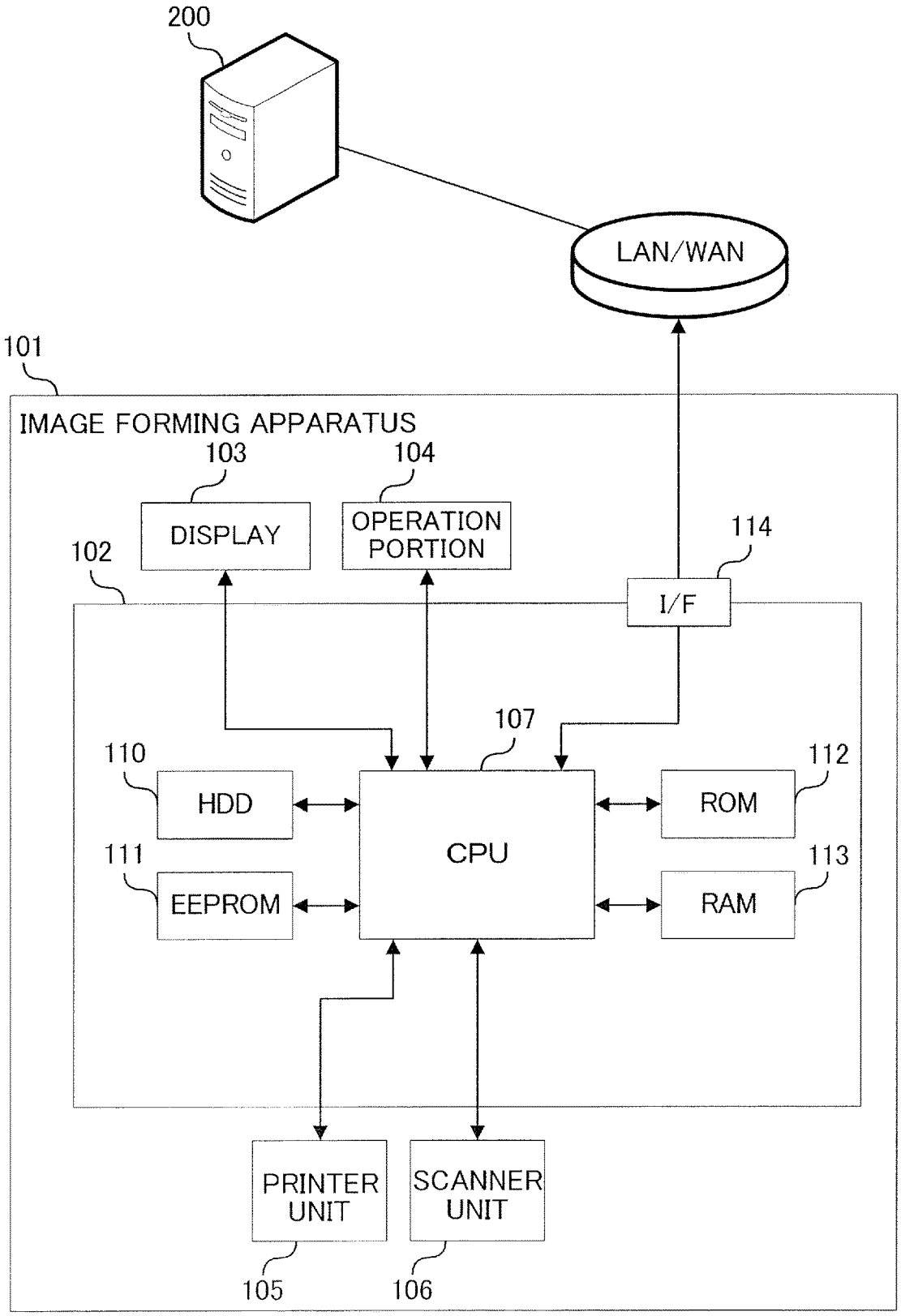
FIG. 1 is a block diagram illustrating an overall configuration of an image forming system of the present disclosure.

An image forming apparatus of the present disclosure will be described below with reference to the drawings. FIG. 1 illustrates a schematic configuration of a system including an image forming apparatus 101 of the present embodiment. The image forming apparatus 101 comprises a function unit including a printer unit 105 and a scanner unit 106 and a display 103 and an operation portion 104 which are notification portions serving as user interfaces. The image forming apparatus 101 also comprises a control unit 102 configured to control these devices.

The display 103 includes a LED as a display lamp and a liquid crystal display and displays a result of an operation made by a user and an internal condition of the apparatus based on a signal from the control unit 102. The operation portion 104 includes a control structure for realizing a hard key group and a touch panel function of the display 103 and receives the operation of the user and transmits it to the control unit 102 as an electronic signal.

The scanner unit 106 is configured to scan a document based on an instruction made by the control unit 102 to read image data and to transmit the obtained image data to the control unit 102. The printer unit 105 is configured to execute an image forming operation, i.e., a printing operation, by receiving the instruction of the control unit 102.

The control unit 102 is composed of a control circuit including a CPU 107, a HDD 110, an EEPROM 111, a ROM 112, and a RAM 113. Here, the CPU is an abbreviation of a central processing unit, the ROM is that of a read only memory, the HDD is that of a hard disk drive, and the EEPROM represents an electrically rewritable nonvolatile memory.

The CPU 107 is an execution medium of a control program stored in the ROM 112 and others and is configured to control mechanical and electrical operations of the devices connected to the control unit 102. For instance, the CPU 107 causes the printer unit 105 to carry out an image forming operation to execute an image forming job. Here, the image forming job is a task of the image forming operation to be executed by the control unit 102 and specifically refers to a data stream including image data of each page, a number of copies, a size and a type of a sheet, setting of a function such as duplex printing and stapling, and others. The image forming job includes a copy job, generated by the control unit 102, based on image data obtained by the scanner unit 106 and a PDL job inputted from an outside and described later.

The ROM 112 is configured to store a boot program and others needed for starting the system, and the RAM 113, i.e., a volatile memory, is used as a work memory in executing a control program. The HDD 110 is a storage medium such as a magnetic disk and stores the control program, image data, and others. The EEPROM 111 stores setting values needed in executing the control program.

The CPU 107 is one exemplary controller configured to control the image forming apparatus 101. It is noted that each processing step of the following flowcharts illustrating a process for controlling the image forming apparatus 101 will be executed by the CPU 107 unless specified otherwise. All of the ROM 112, the RAM 113, the HDD 110 and the EEPROM 111 are also exemplary storage portions capable of temporarily or permanently storing information based on an instruction of the controller. The ROM 112 and others store programs and others for causing the CPU 107 to execute each step of the flowcharts. The EEPROM 111 stores information, e.g., a sheet size, a sheet type and a type-free setting, concerning each sheet support portion described later.

The CPU 107 is connected with a local or wide area network (LAN/WAN) through the network interface (I/F) 114 serving as a transmission/receiving device. Thereby, the control unit 102 can transmit/receive data with a host computer such as a personal computer (PC) 200. For instance, the CPU 107 receives an image forming job (referred to as a 'PDL job' hereinafter) described in a Page Description Language: PDL) from the PC 200. The CPU 107 also transmits an internal state of the image forming apparatus 101 such as progress of the image forming job and a remaining amount of sheets to the host computer.

Hardware Structure of Image Forming Apparatus

Figure 2A:
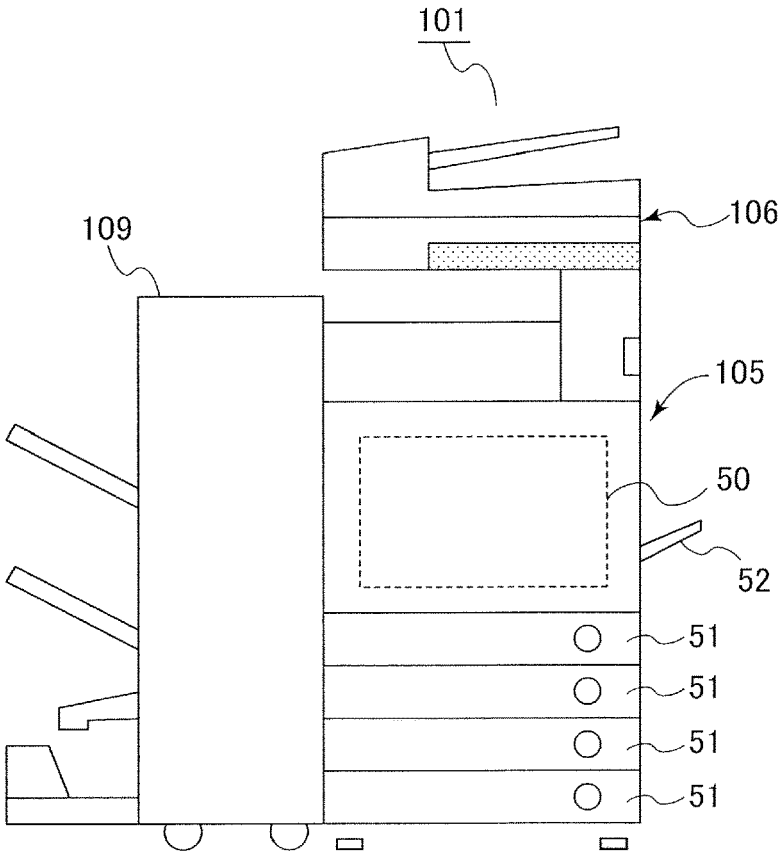
FIG. 2A is a front view illustrating an appearance of an image forming apparatus.

Next, a hardware structure of the image forming apparatus 101 will be described with reference to FIGS. 2A, 2B and 3. As illustrated in FIG. 2A, the printer unit 105 of the image forming apparatus 101 includes an image forming engine 50 disposed within the apparatus body (housing) and a plurality of sheet support portions 51 and configured to support the sheet, i.e., the recording medium. Here, the sheet includes, besides a plain sheet, a special sheet such as a coated sheet, a recording medium having a specific shape such as an envelope and an index sheet, a plastic film for an overhead projector, and a cloth. It is noted that while a term 'sheet' is often used in the following description and in the drawings, it is handled as an acronym of the sheet including a material other that a sheet of paper unless otherwise specified. FIG. 3 is a schematic diagram illustrating a detailed structure of the printer unit 105. As illustrated in FIG. 3, the printer unit 105 includes an image forming engine 50, a pickup roller 61, a registration roller 62, a fixing unit 7, a discharge roller 63, a discharge tray 64 and a plurality of conveyance rollers 65 through 68. The pickup roller 61, the registration roller 62, the discharge roller 63 and the conveyance rollers 65 through 68 compose a sheet conveyance portion 69 configured to convey a sheet. The electro-photographic type image forming engine 50 serving as an image forming portion includes a photosensitive drum 1, an electrifying roller 2, an exposure unit 3, a developing roller 4 and a transfer roller 5.

In response to an instruction to start the image forming operation, a photosensitive drum 1 serving as a photoconductor rotates, and a surface of the drum is homogeneously electrified by an electrifying roller 2. Then, an exposure unit 3 outputs a laser beam modulated based on image data transmitted from the control unit 102 and scans the surface of the photosensitive drum 1 to form an electrostatic late image. This electrostatic latent image is visualized or developed by toner supplied from a developing unit 4 as a toner image.

In parallel with such image forming operation, a feed operation of feeding a sheet supported by either one of the sheet support portions 51 and 52 to the image forming engine 50 is executed. As illustrated in FIGS. 2A and 3, the sheet support portions include a plurality of sheet feed cassettes 51 attached drawably to the housing of the printer unit 105 and the manual feed tray 52 disposed on a side surface of the housing.

The sheet placed on the sheet feed cassette 51 is fed while being separated one by one by a pickup roller 61 and a separation roller pair not illustrated. The sheet fed from the sheet feed cassette 51 or the manual feed tray 52 is sent to a registration roller 62 so that a skew thereof is corrected and is conveyed in synchronism with an advance of the image forming process of the image forming engine 50. Then, a transfer unit 5 transfers the toner image formed on the photosensitive drum 1 onto the sheet. The sheet onto which the non-fixed toner image has been transferred is passed to the fixing unit 7 to be heated and pressurized while being nipped by a roller pair. The sheet onto which the image has been fixed by thus melting and fixing the toner to the sheet is discharged out to a discharge tray 64 by a discharge roller 63. It is noted that the image forming apparatus 101 may be optionally provided with a finisher 109 connected to a side part thereof. This finisher 109 discharges the sheet onto which the image has been formed by implementing a process such as stapling.

It is noted that while the electro-photographic image forming engine 50 has been described as one exemplary image forming apparatus in the present embodiment, another mechanism such as an ink-jet system may be used as the image forming engine. Still further, even in the case of the electro-photographic type, a configuration different from the image forming engine 50 described above such as an image forming engine capable of forming a color image by a tandem intermediate transfer type may be used.

The CPU 107 recognizes sheet attribute information concerning attributes of the sheet placed in the respective sheet feed cassette 51 and the manual feed tray 52 through an operation of the user made through the operation portion 104. Here, the 'attribute of the sheet' is a generic name of features such as a sheet size, an orientation of the sheet, quality of material, e.g., a basis weight, whether a surface is treated, a raw material, a shape such as an index sheet, a loose-leaf, and a special use such as an envelope. The CPU 107 stores the sheet attribute information directly inputted by the user and sheet attribute information such as size and type obtained through a detection mechanism disposed at the respective sheet feed cassettes 51 and the manual feed tray 52 in the EEPROM 111.

It is noted that there is a case where the sheet attribute information is stored in the EEPROM 111 by being respectively related to these sheet feed cassettes 51 and the manual feed cassette 52 and is different from sheet attribute information of a sheet actually placed on the sheet feed cassette 51 and the manual feed tray 52. Still further, it is also possible to arrange such that the sheet size and type placed on the sheet feed cassette 51 can be automatically detected. Still further, it is supposed that a driver setting priority mode described later cannot be set for the sheet feed cassette 51, and specific size and type are always set for the sheet feed cassette 51.

Figure 2B:
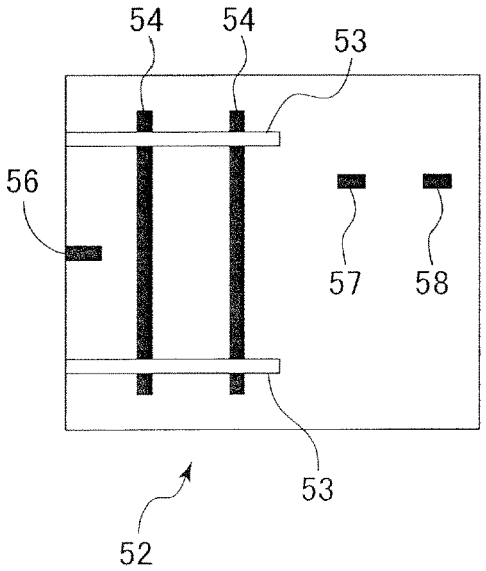
FIG. 2B is a schematic diagram illustrating a configuration of a manual feed tray.
Figure 3:
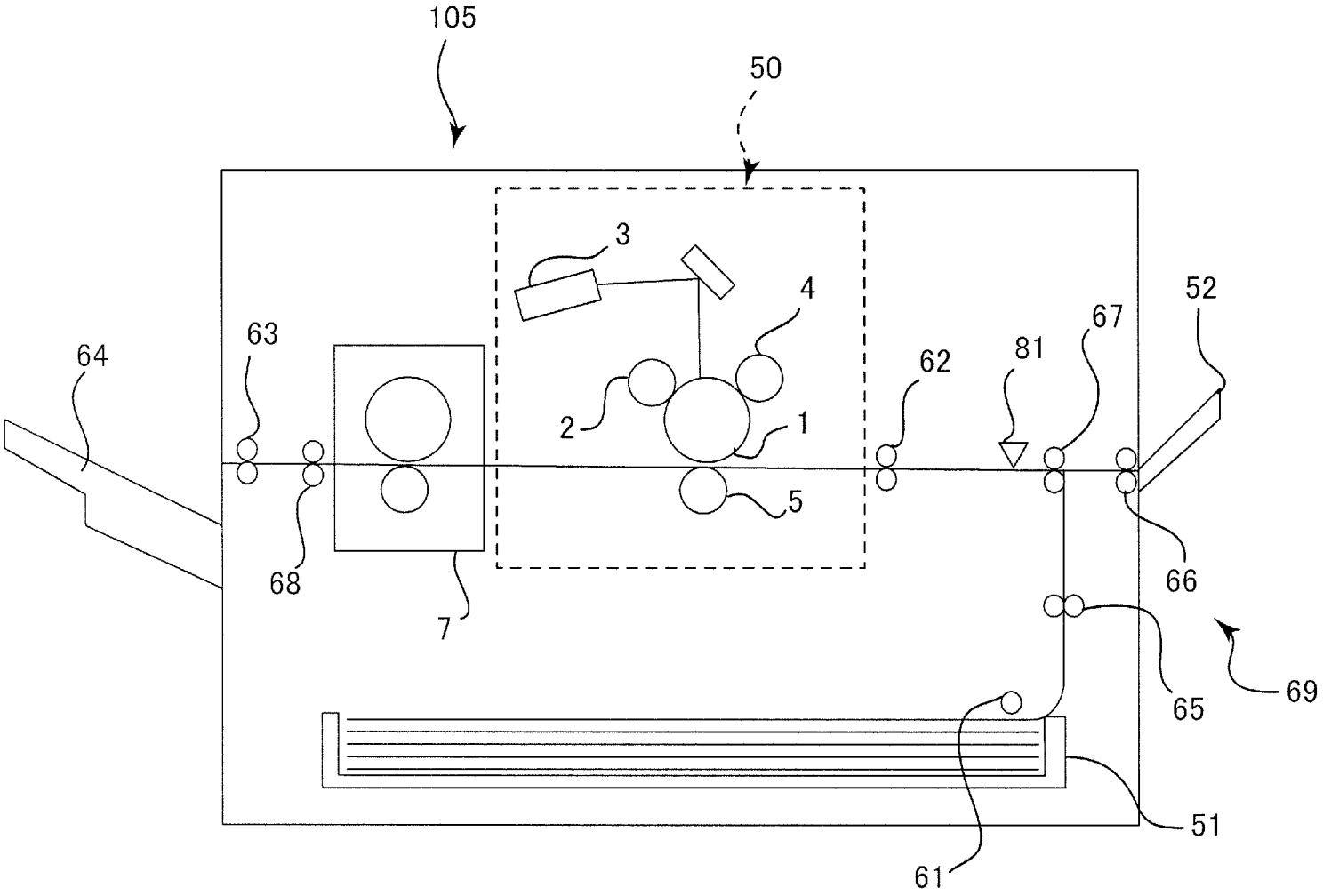
FIG. 3 is a schematic diagram illustrating a configuration of a printer unit.

It is noted that as illustrated in FIG. 2B, the manual feed tray 52 serving as a sheet support portion is provided with a sheet detection sensor 56, a pair of side guides 53, a pair of guide width sensors 54 serving as a sheet width detection portion, and length detection sensors 57 serving as a sheet length detecting portion. The sheet detection sensor 56 is disposed at a downstream end of the manual feed tray 52 in a sheet feed direction (in a left direction in FIG. 2B) and emits a detection signal by detecting a sheet placed on the tray. The side guides 53 are movable along a rail extending in a width direction orthogonal to the sheet feed direction and detect a widthwise position by the guide width sensors 54. The length detection sensors 57 and 58 are disposed at least at one place in the sheet feed direction to detect whether the sheet is present at the position where the sensor is installed. These configurations make it possible for the CPU 107 to obtain information concerning the sizes of the sheet placed on the manual feed tray 52 based on detection signals from the guide width sensor 54 and the length detection sensors 57 and 58. It is noted that although the manual feed tray 52 is not provided with a sensor for detecting the sheet type such as a plan sheet or a thick sheet in the present embodiment, the manual feed tray 52 may be provided with such sensor in a condition in which such sensor is inoperative.

FIG. 4 is a combination table in a case where the CPU 107 automatically determines where a sheet placed on the manual feed tray 52 is a regular size sheet. The CPU 107 determines whether a sheet match with any condition described in FIG. 4 and if the sheet placed on the manual feed tray 52 is a regular size sheet from information obtained from the guide width sensors 54 and the length detection sensors 57 and 58. In the table, a case where the length detection sensors 57 and 58 detect the sheet placed on the manual feed tray 52 is indicated by 'o' and a case where no sheet is detected is indicated by 'x'. For instance, in a case where the guide width sensors 54 detect width information of 140±5 mm and none of the length detection sensors 57 and 58 detects the sheet as indicated in a table combination step 71, the CPU 107 determines that the sheet placed on the manual feed tray 52 is an A5 horizontal regular size sheet.

Meanwhile, in a case where the guide width sensors 54 detects width information of 140±5 mm and only the length sensor 57 detects the sheet as indicated in a combination step 73, the CPU 107 determines that the sheet is an irregular size sheet because there is no corresponding regular size sheet. In a case where the guide width sensors 54 detect width information of 140±5 mm and only the length sensor 58 detects the sheet, the CPU 107 determines that it is impossible to detect because the sensor may be in failure or the sheet is erroneously placed on the manual feed tray 52. It is because the length sensor 57 is disposed downstream of the length sensor 58 in the sheet conveyance direction as described above, and such a condition that the length sensor 57 is OFF and the length sensor 58 is ON is impossible to occur.

In FIG. 4, in a case where detection widths of the guide width sensors 54 are divided as 140±5 mm, 182±5 mm, 210±5 mm, 257±5 mm and 297±5 mm, and width information other than those are determined basically to be irregular size. Then, in cases of combination steps 71, 74, 75, 76, 77, 78, 79 and 80, the sheet is determined to be regular size respectively indicated in the table. Size information of the respective regular sizes is stored in the ROM 112 and others in advance.

While a sheet length of the sheet placed on the manual feed tray 52 can be determined by the length detection sensors 57 and 58 as described above if the sheet is a regular size sheet, it is unable to detect a sheet length of an irregular size sheet by the length detection sensors 57 and 58. However, it is possible to determine the sheet length of the sheet even if the sheet is an irregular size sheet by measuring a time taken until when a trailing edge of the sheet passes through a predetermined position on the sheet conveyance direction from when a leading edge of the sheet has passed through the predetermined position while conveying the sheet and by measuring conveyance speed of the sheet during that time. According to the present embodiment, the CPU 107 calculates a sheet length L by a time during which a sheet detecting sensor 81 disposed between the conveyance roller 67 and the registration roller 62 as illustrated in FIG. 3 detects the sheet being conveyed and a conveyance speed of the sheet during that time.

Figure 5:
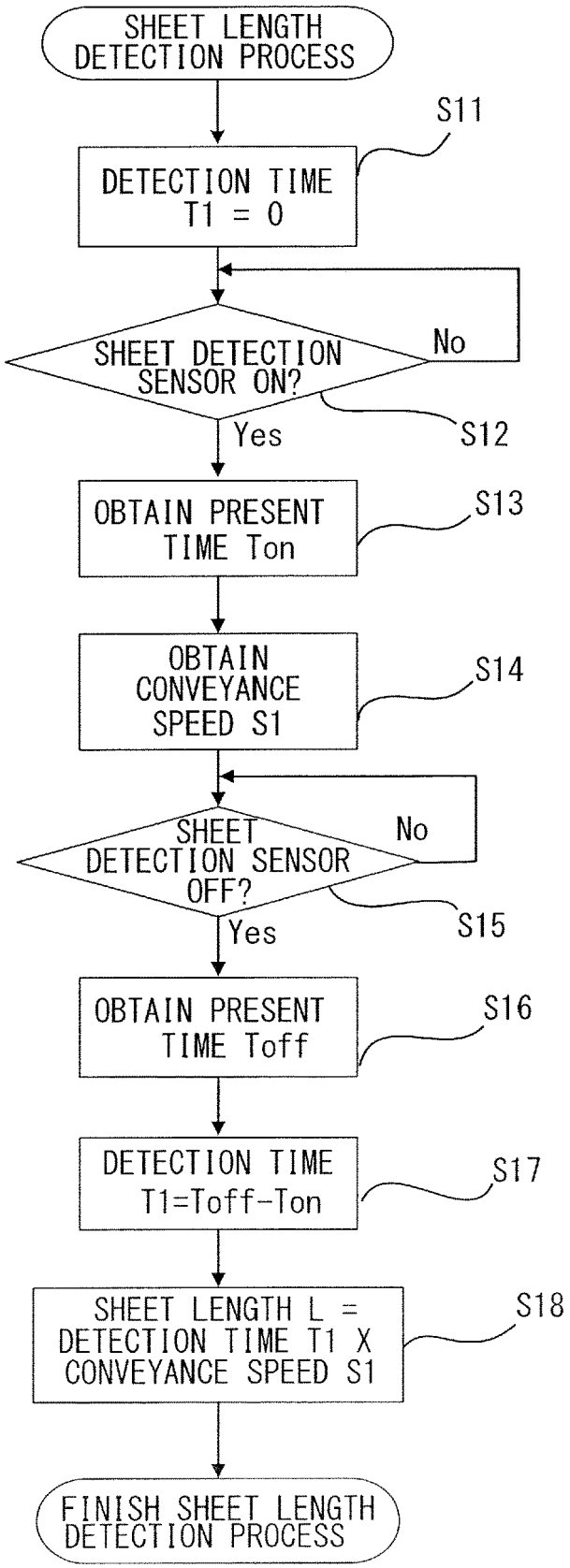
FIG. 5 is a flowchart illustrating a procedure of a sheet length detection process.

A sequence in which the CPU 107 finds the sheet length L which is a sheet length of an actually conveyed sheet will be described with reference to FIG. 5. The CPU 107 zeros a value of a detection time T1 at first in Step S11 and waits until when the sheet detecting sensor 81 serving as a conveyed sheet length detection portion turns On in Step S12. In response to the sheet detecting sensor 81 which is turned ON, i.e., Yes in Step S12, the CPU 107 obtains time Ton at the moment when the sheet detecting sensor 81 is turned ON in Step S13 and also obtains a conveyance speed S1 at the present moment in Step S14.

Next, the CPU 107 waits until when the sheet detecting sensor 81 turns OFF in Step S15. Then, in response to the sheet detecting sensor 81 which has turned OFF, i.e., Yes in Step S15, the CPU 107 obtains time Toff at that moment in Step S16. Then, the CPU 107 calculates a detection time T1 by subtracting the time Ton from the time Toff, i.e., T1=Toff−Ton, in Step S17. The CPU 107 calculates the sheet length L by accumulating the detection time T1 with the conveyance speed S1, i.e., L=T1×S1, in Step S18, and finishes the sheet length detecting process. The sheet length L calculated by the CPU 107 is stored in the RAM 113.

Driver Setting Priority Function

Here, a driver setting priority mode mounted in the image forming apparatus 101 will be described. The sheet attribute information of the sheet supported in the sheet feed cassette 51 and the manual feed tray 52 is stored in a storage portion of the EEPROM 111 or the like as described above. Meanwhile, information specifying the sheet support portion serving as a sheet supplying source and information specifying the sheet size and orientation are included in the PDL job receiving from the external host computer. In general, the sheet attribute information included in the PDL job is often demanded to coincide with the sheet attribute information stored in the storage portion as a prerequisite for starting the image forming operation in a case of executing the PDL job. However, in this case, the user needs to carry out both setting operations of the sheet attribute information set through the driver software and the sheet attribute information set through the operation portion of the image forming apparatus. Still further, in a case where the user executes printing while frequently replacing a plurality of types of sheets having different attributes, the user needs to set the sheet attribute information again every time when the user replaces the sheets, thus increasing an operational burden of the user.

Then, it is conceivable to provide a function of executing the image forming operation by preferentially using the sheet attribute information included in the PDL job with respect to the sheet attribute information stored in the storage portion about a part or a whole of the sheet support portions provided in the image forming apparatus. Such function will be referred to as a 'driver setting priority function' hereinafter, and a mode in which the CPU 107 executes the image forming job in a state in which the driver setting priority function is enabled will be referred to as a 'driver setting priority mode' hereinafter. A mode in which the CPU 107 executes the image forming job in a state in which the driver setting priority function is disabled will be referred to as a 'regular mode' hereinafter for a convenience of the description. The regular mode corresponds to a first mode in executing the image forming job, and the driver setting priority mode corresponds to a second mode in executing the image forming job.

It is noted that although the present embodiment is arranged such that the driver setting priority mode is applicable only to the manual feed tray 52, it is possible to arrange such that the driver setting priority mode is applicable also to the other sheet support portion. Still further, while the present embodiment is arranged to be able to switch whether the driver setting priority function is enabled or disabled by an operation using the operation portion 104, it is also possible to arrange to be able to set on the host computer side through the driver software.

A setting changing process for switching enabled or disabled of the driver setting priority function of the present embodiment will be described with reference to FIGS. 6 and 7. Here, FIG. 6 is a flowchart illustrating a procedure of the setting changing process for changing the setting of the driver setting priority mode to the manual feed tray 52, and FIG. 7 is an image representing a setting change screen 401 displayed on the display 103 in the setting changing process.

Figure 6:
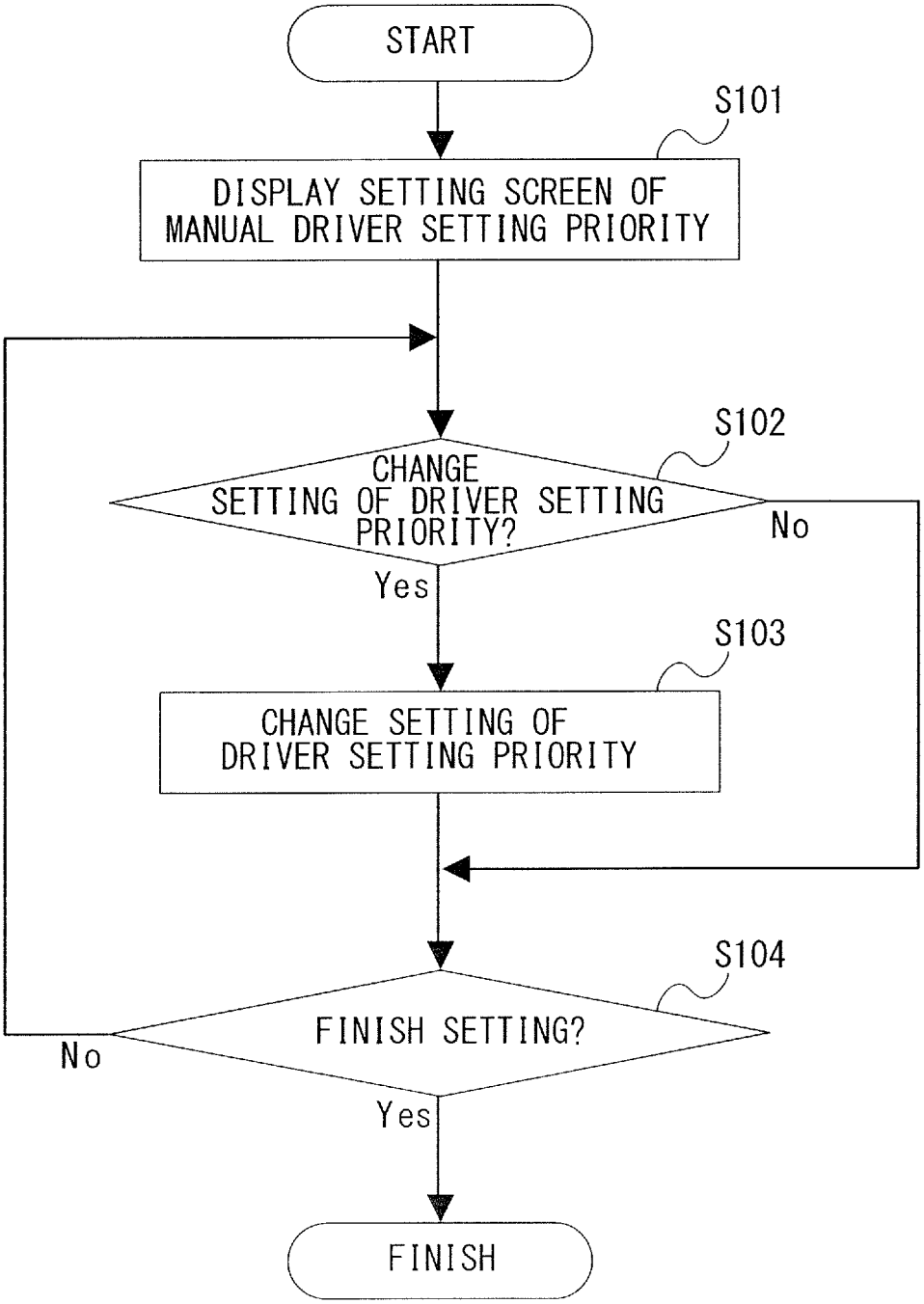
FIG. 6 is a flowchart illustrating a procedure of a setting changing process of a driver setting priority function.
Figure 7:
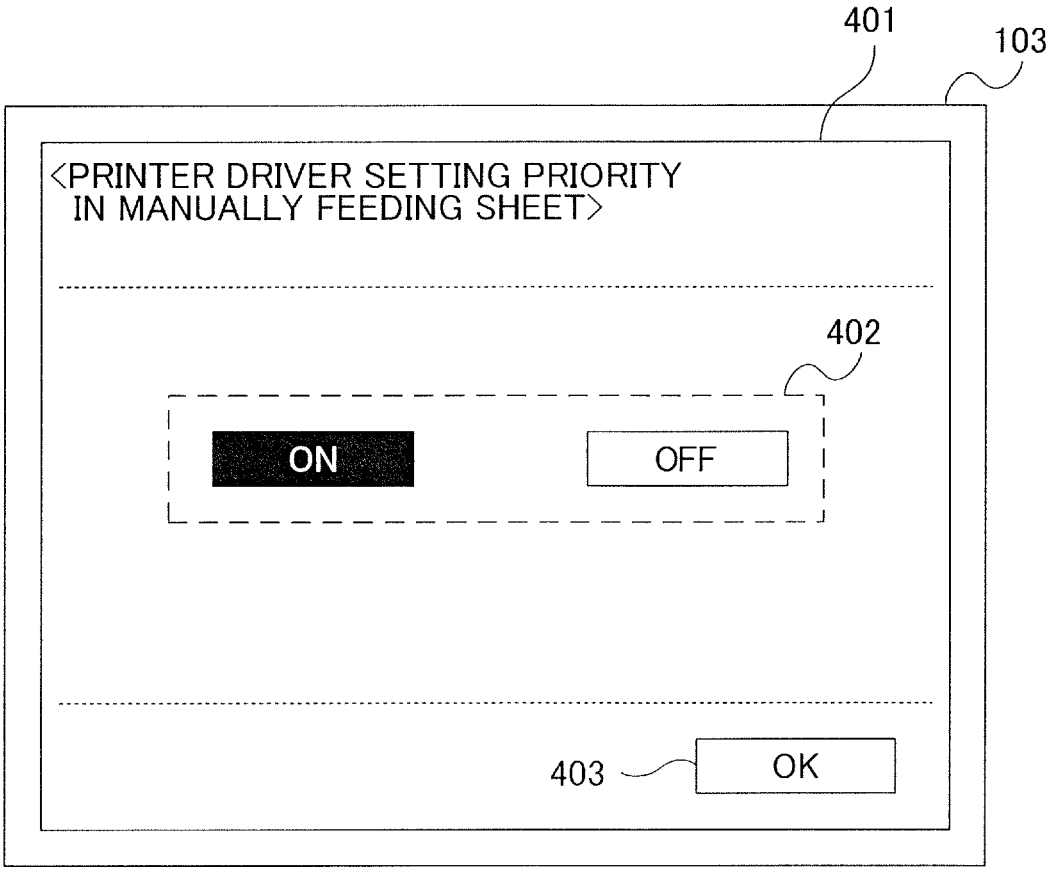
FIG. 7 is an image illustrating a setting changing screen of the driver setting priority function.

The setting changing process illustrated in FIG. 6 is started in a case where a setting key, displayed on the display 103, is pressed in a standby condition in which the image forming apparatus 101 stands by an input of the image forming job. When the setting changing process is started, the CPU 107 displays a setting change screen 401 (see FIG. 7) on the display 103 in Step S101 and stands by an input of a control signal of an ON/OFF key 402 and an OK key 403.

In a case where one different from what has been already set among the ON/OFF key 402 is selected, i.e., Yes in Step S102, the CPU 107 changes the setting concerning the driver setting priority function in Step S103. Specifically, the CPU 107 rewrites a value of a variable representing whether the driver setting priority function is enabled or disabled stored in the EEPROM 111. The CPU 107 accepts such change of setting until when the OK key 403 is pressed, and if the OK key 403 is actually pressed i.e., Yes in Step S104, the CPU 107 finishes the setting changing process. In a case where the image forming apparatus 101 receives a PDL job, the CPU 107 determines whether the driver setting priority function is enabled by collating the variable stored in the EEPROM 111 as described later.

Setting of Sheet Attribute

Figure 8:
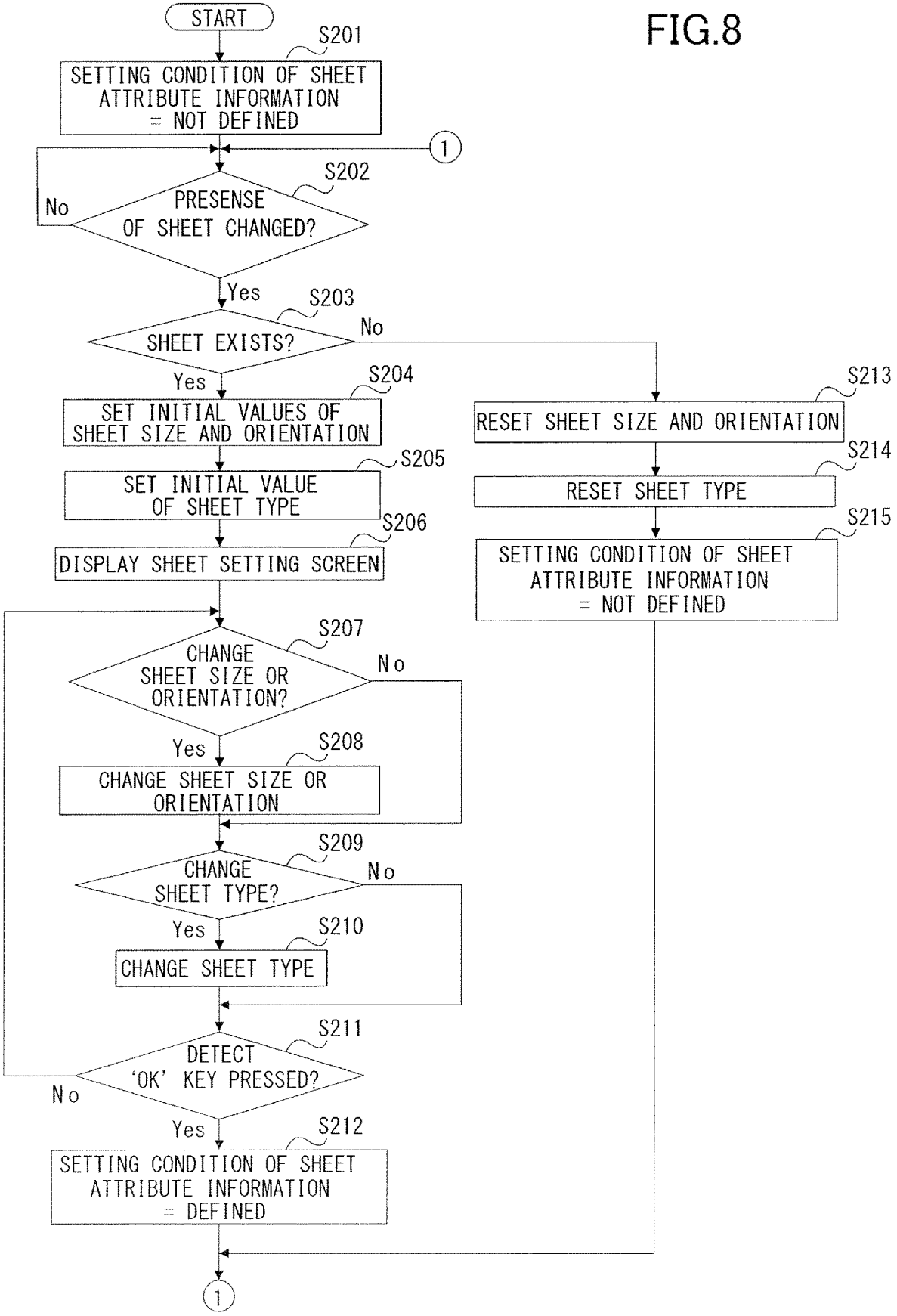
FIG. 8 is a flowchart illustrating a procedure of a sheet attribute information setting process concerning the manual feed tray.
Figure 9:
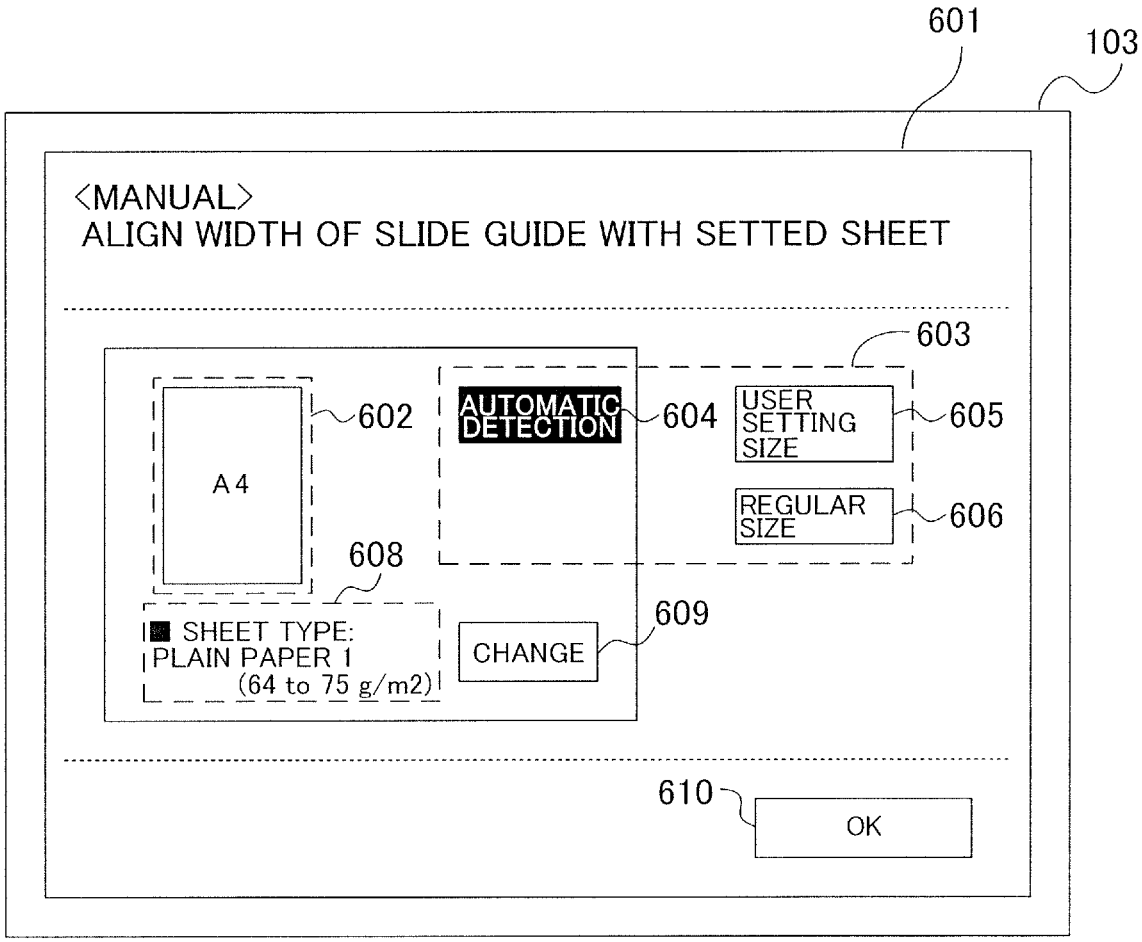
FIG. 9 is an image illustrating a sheet attribute information setting screen.
Figure 10:
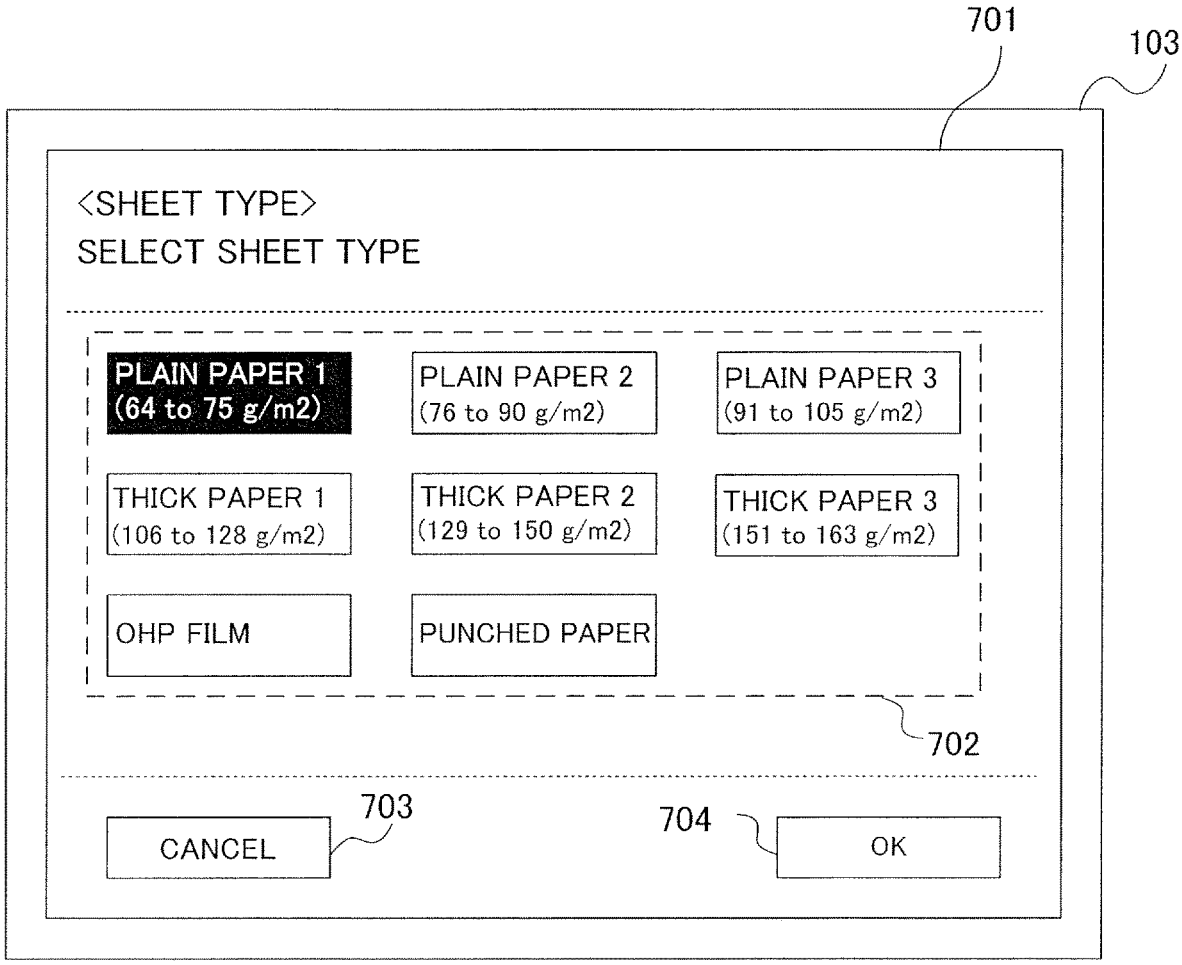
FIG. 10 is an image illustrating a sheet type selection screen.

Next, a sheet attribute setting process for setting the sheet attribute information concerning a sheet placed on the manual feed tray 52 for the image forming apparatus 101 will be described with reference to FIGS. 8 through 10. Here, FIG. 8 is a flowchart illustrating a procedure of the sheet attribute setting process, and FIGS. 9 and 10 are images illustrating screens displayed on the display 103 in the sheet attribute setting process. Although the setting process targeting on the manual feed tray 52 will be described in the following description, a similar setting process may be executed also on each sheet feed cassette 51.

It is noted that the 'sheet orientation' among the sheet attributes is what refers to a 'long edge feed orientation' in which a long side of a sheet runs in parallel with the sheet feed direction, or to a 'short edge feed orientation' in which a short side of the sheet runs in parallel with the sheet feed direction. The 'sheet type' represents categories of the sheet by attributes other than the sheet size and the orientation, and eight types of sheets as illustrated in FIG. 10 can be utilized in the present embodiment.

The sheet attribute setting process as illustrated in FIG. 8 is structurally executed in a condition in which a main power source of the image forming apparatus 101 is ON. The CPU 107 sets a value of a 'sheet attribute information setting condition' which is a setting variable representing whether the sheet attribute information is defined as 'not defined' in an initial condition in Step S201. Then, the CPU 107 executes a process corresponding to a content of change if a detection signal of the sheet detection sensor 56 (see FIG. 2B) disposed on the manual feed tray 52 is changed, i.e., Yes in Step S202.

In a case where the control unit 102 detects that the sheet is placed on the manual feed tray 52 through the sheet detection sensor 56, i.e., Yes in Step S203, changed from none to present, the CPU 107 substitutes setting variables representing the sheet size and orientation with initial values in Step S204. Here, the initial value refers to a value determined by using the size detection portions 54, 57 and 58 disposed on the manual feed tray 52 or to a pre-installed fixed value. The user specifies in advance which values should be the initial value.

The CPU 107 also substitutes a setting value representing the sheet type with an initial value in Step S205. While a pre-installed sheet type will be set as the initial value in the present embodiment, it is also possible to arrange such that the user can select the initial value in advance. Still further, in the case of the arrangement in which the detection mechanism capable of obtaining information concerning the sheet type is disposed on the manual feed tray 52, the type determined based on a detection result may be set as the initial value.

Next, the CPU 107 displays a sheet setting screen 601 as illustrated in FIG. 9 on the display 103 in Step S206. Information representing the sheet size and orientation set at present is displayed in an area 602 of the sheet setting screen 601, and the sheet type set at present is displayed in an area 608. Accordingly, the information representing the initial values of the size and orientation and the initial value of the type are displayed at the moment when the sheet setting screen 601 is displayed.

Various operation keys 604 through 606 for changing the sheet size and orientation are displayed in the area 603 of the sheet setting screen 601. In the case as illustrated in FIG. 9, an 'automatic detection' key 604 is selected, so that values specified based on the detection results of the guide width sensor 54 and the length detection sensors 57 and 58 are set as the sheet size and orientation. In a case where a 'user setting size' key 605 is pressed, a screen urging the user to input arbitrary values indicating a sheet length, i.e., a length in the sheet feed direction, and a sheet width, i.e., a length in the width direction orthogonal to the sheet feed direction, is displayed. In a case where a 'regular size' key 606 is pressed, a screen enabling to select size and orientation of a sheet out of a candidate group of regular size sheet is displayed.

A 'change' key 609 for changing the sheet type is displayed on the sheet setting screen 601. In a case where the 'change' key 609 is pressed, the CPU 107 displays a select screen 701 as illustrated in FIG. 10 on the display 103. Operation keys selectable and associated with the sheet types handled by the image forming apparatus 101 are listed in an area 702 of the select screen 701. A 'cancel' key 703 for halting the operation without changing the sheet type and an 'OK' key 704 for defining a selection result are also displayed on the sheet setting screen 601. In a case where either of the 'cancel' key 703 and the 'OK' key 704 are operated, the select screen 701 is closed and the sheet setting screen 601 is displayed.

As illustrated in FIG. 8, in a case where an operation of changing at least one of the sheet size and orientation is made in the state in which the sheet setting screen 601 is displayed, i.e., Yes in Step S207, the CPU 107 stores a value after the change to the EEPROM 111 in Step S208. Still further, in a case where an operation of changing the sheet type is made, i.e., Yes in Step S209, the CPU 107 also stores a value after the change to the EEPROM 111 in Step S210. Then, if the 'OK' key 610 of the sheet setting screen 601 is pressed, i.e., Yes in Step S211, the CPU 107 sets the value of the 'sheet attribute information setting condition' to 'definite' in Step S212 and returns to the standby condition in Step S202 in which the CPU 107 stands by a change of the detection signal of the sheet detection sensor 56.

In a case where the CPU 107 detects that the sheet has been removed from the manual feed tray 52 in the standby condition in contrary, i.e., No in Step S203, change from present to none, the CPU 107 resets the information concerning the sheet size and orientation and the information concerning the sheet type in Steps S213 and S214. That is, the CPU 107 cancels the set values of the sheet attribute information from the storage portion. Then, after setting the value of the 'sheet attribute information setting condition' to 'non-definite' in Step S215, the CPU 107 returns to the stand-by condition in Step S202. It is noted that the image forming apparatus 101 may have an every-time setting mode of displaying the sheet setting screen 601 on the display 103 every time when a sheet is placed on the manual feed tray 52 and a fixed mode of displaying the sheet setting screen 601 on the display 103 even if a sheet is placed on the manual feed tray 52. In the every-time setting mode, the sheet size and the type are set by the user on the sheet setting screen 601 as described above. In the fixed mode, the procedure in Steps S206 through S211 in FIG. 8 is omitted and initial values set by the user in advance are stored in the EEPROM 111 as information concerning the sheet size and type related to the manual feed tray 52 by placing the sheet on the manual feed tray 52. That is, the information concerning the sheet size and type related to the manual feed tray 52 is inputted by the user from the operation portion and is stored in the EEPROM 111.

PDL Job

A process for executing the PDL job by the image forming apparatus 101 will be described below. At first, contents of data received by the image forming apparatus 101 as the PDL job (referred to as a 'PDL job 800' hereinafter) will be described with reference to FIG. 11. The PDL data 800 is generated by the driver software installed in the host computer and is transmitted to the control unit 102 of the image forming apparatus 101 through a network such as LAN/WAN.

Figure 11:
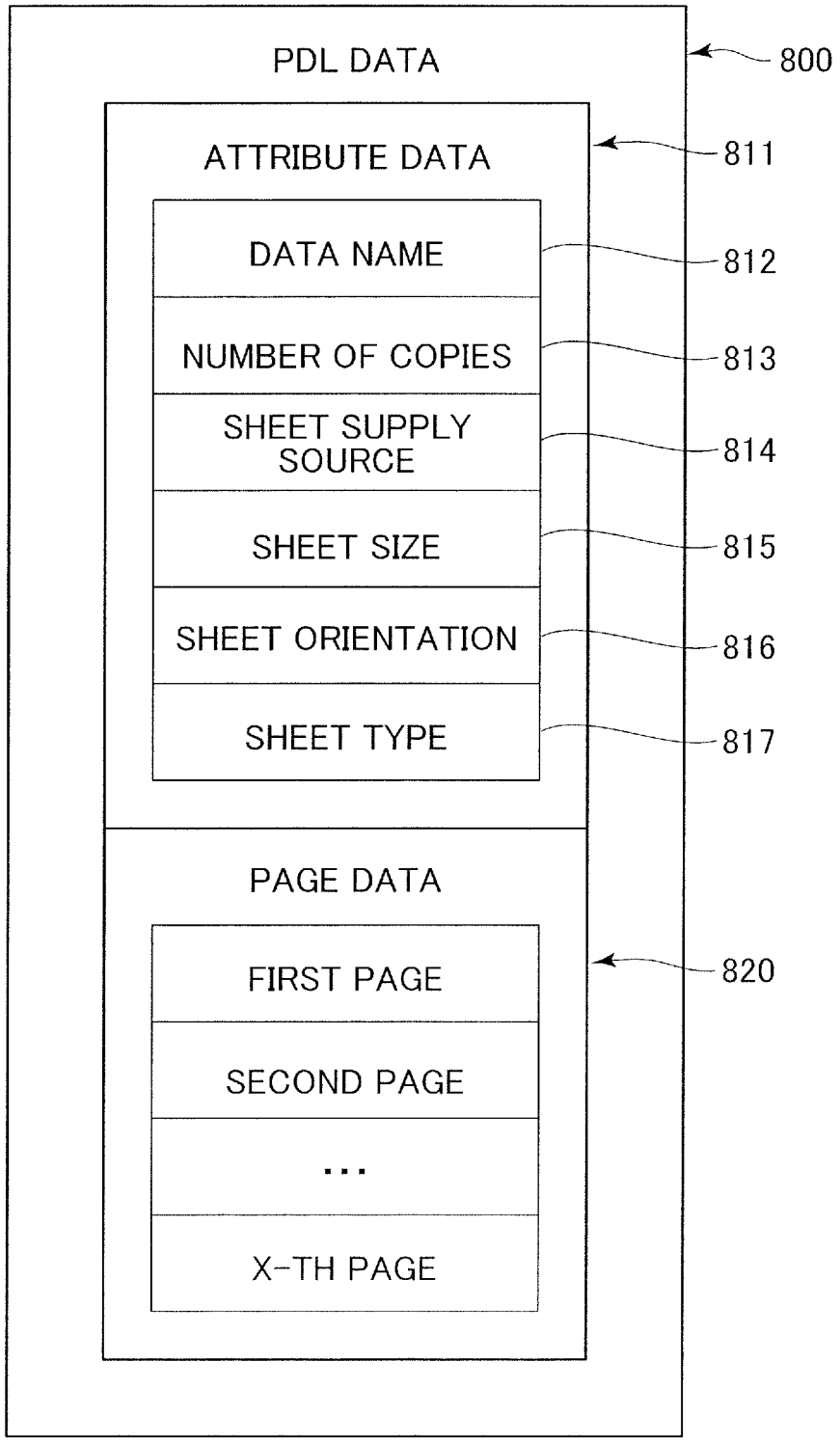
FIG. 11 is a conceptual diagram illustrating contents of PDL data transmitted/received as a PDL job.

As illustrated in FIG. 11, roughly the PDL data 800 includes attribute data 811 representing attributes of the job and page data 820 which is an image data set to be printed. The attribute data 811 includes respective information of a data name 812, a number of copies 813, a sheet supply source 814, a sheet size 815, a sheet orientation 816 and a sheet type 817. The data name 812 is a title for discriminating the PDL data 800 and is assigned based on a file name of application data that has provided the page data 820 to the driver software. The number of copies 813 is information indicating a number of copies. The sheet supply source 814 is information indicating a supply source of the sheet to be used for printing. In a case where the user specifies a specific sheet support portion as the sheet supply source, a value indicating either one of the sheet feed cassettes 51 or the manual feed tray 52 is stored as the sheet supply source 814. It is noted that the assignment of the sheet supply source 814 is arbitrary as for the PDL job, and a value indicating 'automatic selection' is stored as the sheet supply source 814 in a case where the user assigns no sheet supply source.

The sheet size 815 is information indicating a sheet size specified by the user. It is noted that it is essential to specify the sheet size in the PDL job in the present embodiment, and information of the sheet size 815 is always included in the PDL data 800 in the present embodiment. The sheet orientation 816 is information indicating a sheet orientation specified by the user. In a case where the user specifies no sheet orientation, the information of the sheet orientation 816 is omitted. The sheet type 817 is information indicating a sheet type specified by the user. It is noted that the specification of the sheet type 817 to the PDL job is arbitrary, and the information of the sheet type 817 is omitted in a case where the user specifies no sheet type. Still further, in a case where the function such as stapling and duplex printing mounted in the image forming apparatus 101 is used, information instructing to execute a corresponding function besides the respective information described above is included in the attribute data 811. The page data 820 includes image data 821 described in a format of the PDL to which the image forming apparatus 101 corresponds per page.

Figure 12:
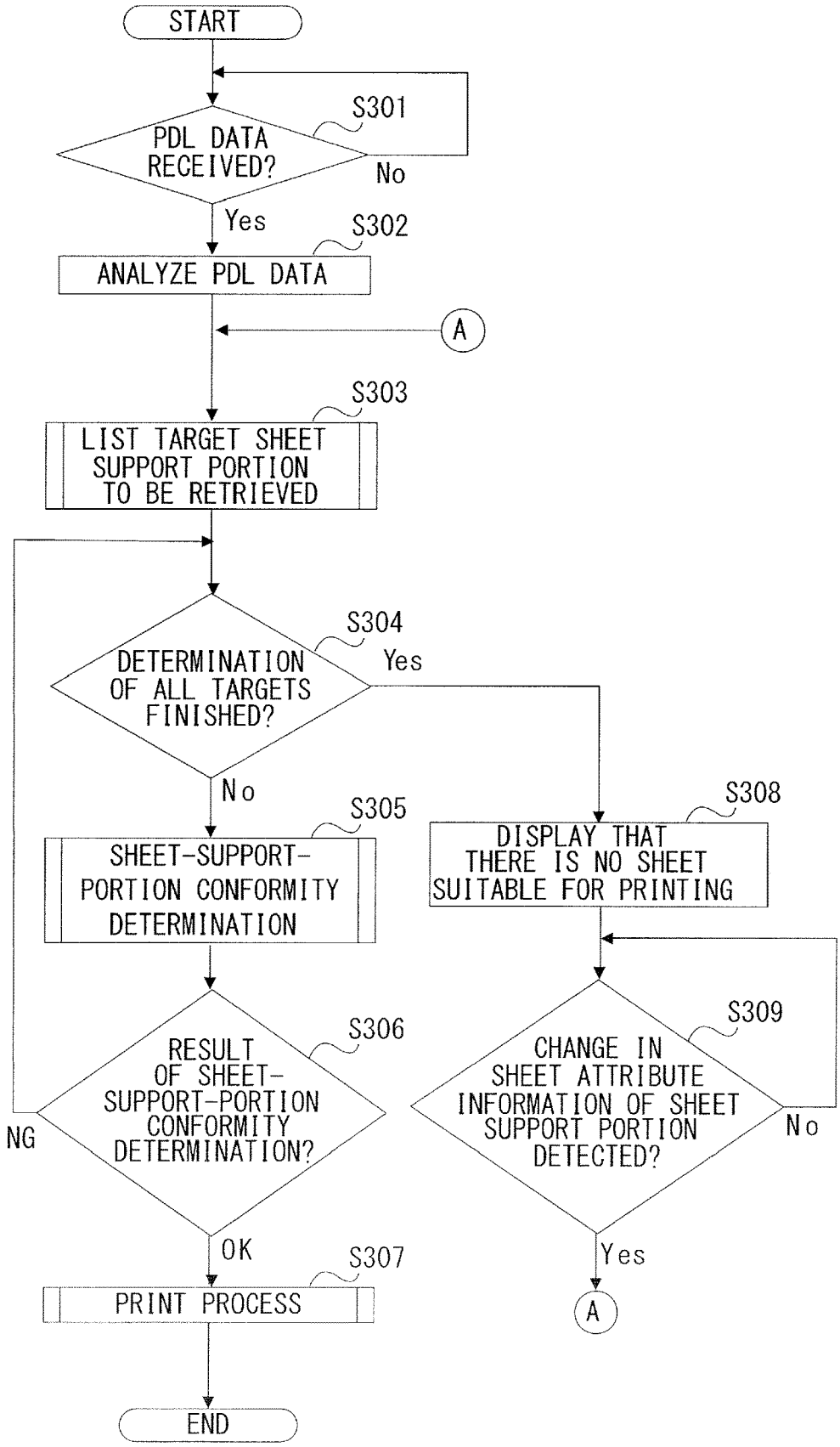
FIG. 12 is a flowchart illustrating a procedure of a PDL job execution process.

An outline of a procedure of an execution process for executing the PDL job will be described with reference to a flowchart of FIG. 12. This execution process is structurally executed in a state in which the main power source of the image forming apparatus 101 is ON and advances adequately when the CPU 107 receives the PDL data. The CPU 107 always confirms whether the PDL data 800 has been received through the network in Step S301. In a case where the CPU 107 receives the PDL data 800, i.e., Yes in Step S301, the CPU 107 analyzes the PDL data 800 and samples information including the sheet supply source 814, the sheet size 815, the sheet orientation 816 and the sheet type 817 of the attribute data 811 in Step S302.

Next, the CPU 107 prepares a list of sheet support portions to be retrieved among the sheet support portions of the image forming apparatus 101 from which one which cannot be a sheet supply source is excluded based on the information of the sheet supply source 814 in Step S303. Then, the CPU 107 executes a sheet-support-portion conformity determination process in Step S305 to determine sequentially whether the sheet support portions included in the prepared list are usable as a sheet supply source in the image forming operation in Steps S304 through S306.

In a case where there is one determined to be OK (conformable) by the sheet-support-portion conformity determination process in the retrieved sheet support portions, i.e., OK in Step S306, the CPU 107 executes a printing process in Step S307. That is, the CPU 107 executes the printing process, i.e., an image forming process, of forming an image based on the page data 820 to the sheet fed from the sheet support portion by the image forming engine 50.

Still further, a condition setting of a function provided in the image forming apparatus 101, e.g., a temperature condition of the fixing unit corresponding to the sheet type 817, is changed in the printing process based on the sheet attribute information stored in the attribute data 811 of the PDL data 800 and/or the EEPROM 111. An image rotating process corresponding to the sheet orientation for example is also executed. The sheet attribute information used at this time is not just what the sheet attribute information stored in the EEPROM 111 in the previous Step S212 (see FIG. 8) but is printing sheet attribute information found in the sheet-support-portion conformity determination process described later. This arrangement makes it possible to realize switching of the printing process corresponding to an 'enabled' or 'disabled' condition of the driver setting priority mode in the previous Step S103 (see FIG. 6). The CPU 107 finishes the printing process when printing of all the pages and all number of copies specified by the PDL data 800 is completed. That is, Steps S305 through S307 are composed of the image forming process or the control process.

Meanwhile, in a case where the result of the sheet-support-portion conformity determination process for all of the retrieved sheet support portions is NG, i.e., non-conformable and Yes in Step S304, the CPU 107 displays on the display 103 that there is no sheet suitable for printing in Step S308. Then, the CPU 107 stands by until when the sheet attribute information for any sheet support portion is changed, and in a case where the CPU 107 detects that the sheet attribute information has been changed, i.e., Yes in Step S309, the CPU 107 executes the preparation of a list of the sheet support portions to be retrieved and the sheet-support-portion conformity determination process again. It is noted that the CPU 107 judges that the sheet has been replaced by the user and the sheet attribute information has been changed if the detection signal of the sheet detection sensor 56 is changed, i.e., Yes in Step S202 in FIG. 8.

Figure 13:
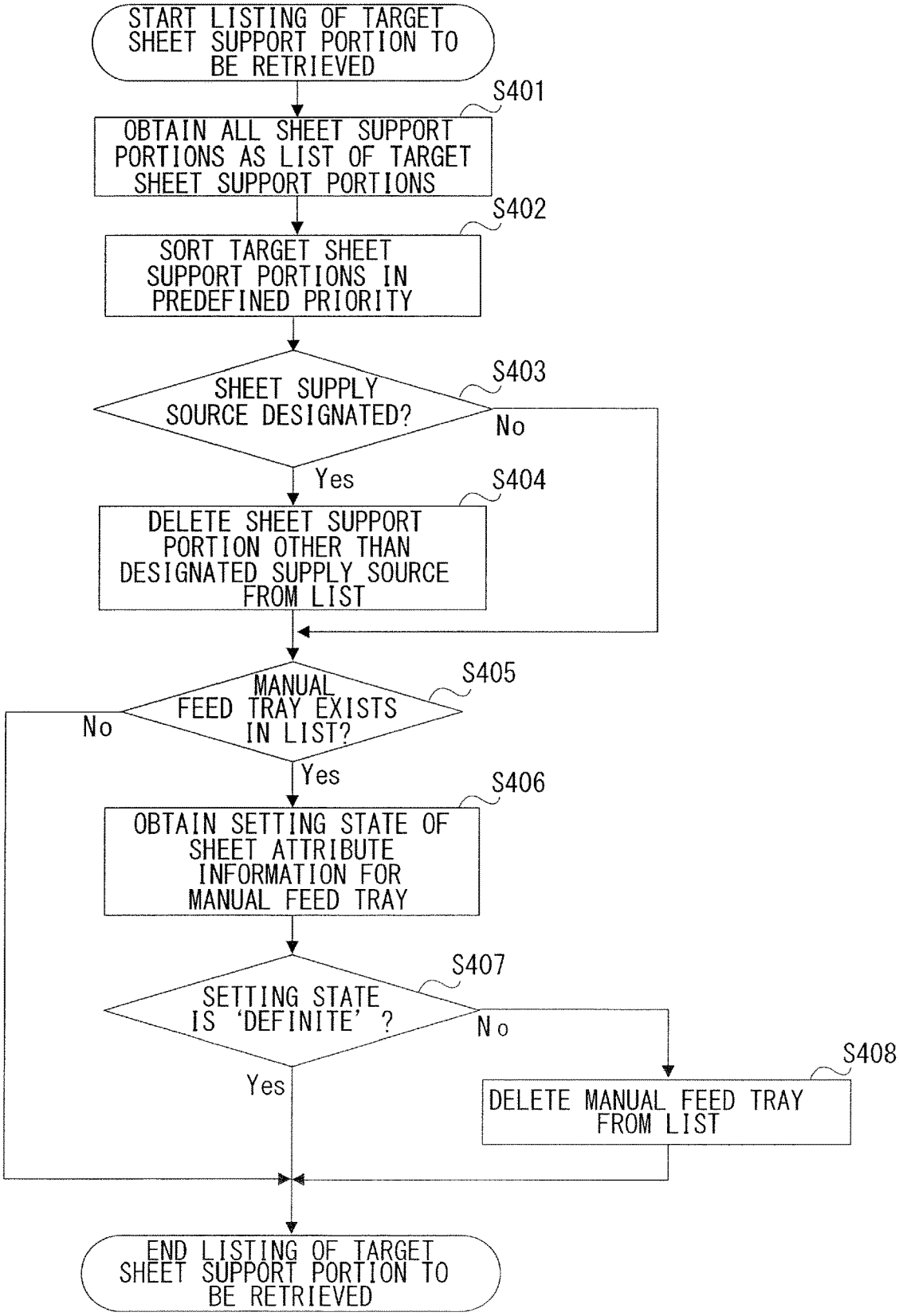
FIG. 13 is a flowchart illustrating a procedure of a process of preparing a list of a sheet support portion to be retrieved as a sheet supply source.

Processing contents in preparing the list of the sheet support portions to be retrieved in Step S303 in FIG. in the PDL execution process described above will be described along a flowchart illustrated in FIG. 13. At first, the CPU 107 obtains a list of all of the sheet support portions provided in the image forming apparatus 101 to make the list of the sheet support portions to be retrieved in Step S401. Next, the CPU 107 sorts the obtained list of the sheet support portions in accordance to predetermined priority levels in Step S402. For instance, the priority level is set such that the sheet feed cassette 51 is higher among the sheet feed cassette 51 and the manual feed tray 52, and such that the closer to the image forming engine 50, the higher the priority level is among the cassettes. Next, the CPU 107 determines whether the information of the sheet supply source exists in the analysis result of the PDL data 800 in Step S403. In a case where the sheet supply source is specified in the PDL job, i.e., Yes in Step S403, the CPU 107 deletes the sheet support portions other than the specified sheet supply source from the list of the sheet support portions to be retrieved in Step S404.

After processing Step S404 or in a case where there is no specification of the sheet supply source in the PDL job, the CPU 107 determines whether the manual feed tray 52 is included in the list of the sheet support portions to be retrieved in Step S405. In a case where the manual feed tray 52 is not included, i.e., No in Step S405, the list of the sheet support portions to be retrieved is defined by the content at that moment, and the CPU 107 finishes preparing the list. In a case where the manual feed tray 52 is included, i.e., Yes in Step S405, the CPU 107 collates the EEPROM 111 to obtain a value of a 'sheet attribute information setting condition' concerning the manual feed tray 52 in Step S406. In a case where the 'sheet attribute information setting condition' is 'definite', i.e., Yes in Step S407, the CPU 107 defines the list of the sheet support portions to be retrieved by the content at that moment. Meanwhile, in a case where the 'sheet attribute information setting condition' is 'indefinite', i.e., No in Step S407, the CPU 107 deletes the manual feed tray 52 from the list of the sheet support portions to be retrieved in Step S408 and finishes to prepare the list.

Figure 14:
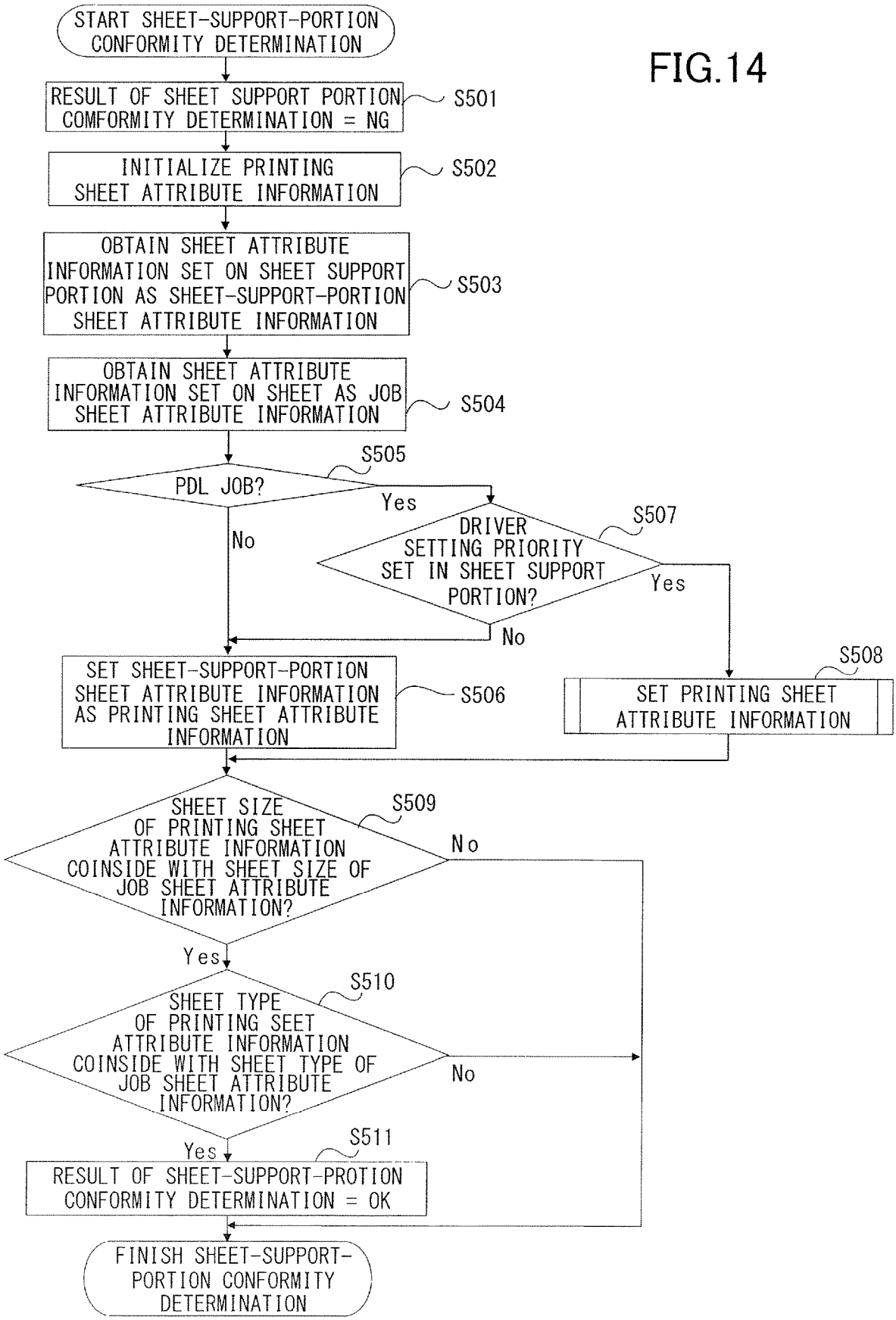
FIG. 14 is a flowchart illustrating a procedure of a conformity determination process for determining whether the target sheet support portion is conformable as a sheet supply source.

In succession, processing contents in executing the sheet-support-portion conformity determination process in Step S305 in FIG. 12 will be described along a flowchart in FIG. 14. It is noted that this conformity determination process is common with a conformity determination process executed in executing an image forming job other than the PDL job such as a copying job.

At first, the CPU 107 sets a variable representing a determination result of the sheet-support-portion conformity determination process as 'NG' to initialize the process in Step S501 and initializes the 'printing sheet attribute information' for use in the printing process in Step S502. Here, the printing sheet attribute information refers to sheet attribute information on the image forming apparatus side 101 recognized by the CPU 107 as a target of the printing process and is temporarily held in the storage portion such as the RAM 113 until the image forming job is finished. Next, the CPU 107 obtains the sheet attribute information stored in the EEPROM 111 concerning the sheet support portion specified as a target of retrieval as 'sheet-support-portion sheet attribute information' in Step S503.

The CPU 107 also obtains the sheet attribute information contained in the image forming job as 'job sheet attribute information' in Step S504. In the case of the PDL job, the job sheet attribute information includes the sheet size 815, the sheet orientation 816 and the sheet type 817 obtained by analyzing the PDL data 800. It is noted that in a case where the sheet orientation 816 is not set, the job sheet attribute information is interpolated based on the sheet size 815.

Next, the CPU 107 determines whether the job of this time can be a target of the operation of the driver setting priority function, i.e., whether it is a PDL job, in Step S505. In a case where it is not the PDL job, i.e., No in Step S505, it is unable to apply the driver setting priority function, so that the CPU 107 continues the process and assigns the value of the sheet-support-portion sheet attribute information to the printing sheet attribute information in Step S506. In a case where it is the PDL job, i.e., Yes in Step S505, the CPU 107 obtains from the setting information whether the driver setting priority function is enabled or not from the EEPROM 111 in Step S507. In a case where the driver setting priority function is disabled (No) at this time, the CPU 107 assigns the value of the sheet-support-portion sheet attribute information to the printing sheet attribute information in Step S506 similarly to the case where a job is not the PDL job. In a case where the driver setting priority function is enabled (Yes), i.e., present in Step S507, the CPU 107 turns to the driver setting priority mode and executes the setting process of the printing sheet attribute information in Step S508. In the driver setting priority mode, the contents of the job sheet attribute information is set in priority to the sheet support portion attribute information as the printing sheet attribute information except of a specific case described later.

Next, the CPU 107 determines whether the sheet size in the printing sheet attribute information is consistent with the sheet size in the job sheet attribute information and whether the sheet type in the printing sheet attribute information is consistent with the sheet type of the job sheet attribute information in Steps S509 and S510. It is noted that in a case where no sheet type is set in the job sheet attribute information, the determination of Step S510 may be omitted. Still further, instead of omitting the determination, it may be arranged such that the same effect with a case where it is determined to be 'consistent' in Step S510 is brought about by determining whether the sheet-support-portion sheet attribute information is included in a specific sheet type group set in advance.

In a case where at least one of determination results of Steps S509 and S510 is 'inconsistent', the CPU 107 judges that it is impossible to execute the image forming job by using this sheet support portion and finishes the process by returning the initial value 'NG' as a determination result. Meanwhile, in a case where both of these determination results are 'consistent', the CPU 107 determines that it is possible to start an operation of forming the image on the sheet fed from this sheet support portion. In this case, the CPU 107 returns 'OK' as a result of the sheet-support-portion conformity determination process and finishes the process in Step S511.

Operation in Driver Setting Priority Mode

Here, features of the operation of the image forming apparatus 101 in the driver setting priority mode will be described. As described above, the CPU 107 determines whether the sheet size and the sheet type coincide between the printing sheet attribute information, obtained by using the sheet support portion attribute information stored in the EEPROM 111 as the printing sheet attribute information, and the job sheet attribute information sampled out of the PDL data in the regular mode. Accordingly, the printing process is carried out only if the sheet attribute information included in the PDL job is conformable with the sheet attribute information stored in the storage portion in the regular mode.

Meanwhile, in the driver setting priority mode, the job sheet attribute information sampled out of the PDL data is used as the printing sheet attribute information in principle. Therefore, in determining consistency/inconsistency of the sheet size and sheet type between the printing sheet attribute information and the job sheet attribute information in the sheet-support-portion conformity determination process, they are always determined to be 'consistent'. That is, in the driver setting priority mode, the printing process is carried out and an image is formed on the sheet even in a case where the sheet attribute information included in the PDL job does not conform to the sheet attribute information stored in the storage portion, i.e., the EEPROM 111. However, the printing process is not always carried out forcibly in the driver setting priority mode as described above, and it becomes necessary to conform to other determination conditions such as whether an enough toner remaining amount is left, whether a sheet to be printed is present, whether it is possible to carry out a process such as stapling.

By the way, in the driver setting priority mode, there may be a case where a sheet size included in the PDL job is different from a sheet size of the sheet placed on the manual feed tray 52. This case corresponds to a case where the user has placed the sheet, having a different size from a sheet size set through the driver software, on the manual feed tray 52 for example. In such a case, image data larger than the sheet placed on the manual feed tray 52 is printed on the sheet, thus causing a case where the user cannot obtain a desired printing result because an end portion of the image may be omitted for example.

Setting of Printing Sheet Attribute Information

Then, according to the present embodiment, an alarm is displayed on the display 103 and the printing is stopped in the case where the sheet size detected by the size detection portion 54, 57 or 58 is different from the sheet size specified in the PDL job in the driver setting priority mode. That is, the display 103 gives notification to the user. The setting process of the printing sheet attribute information, i.e., Step S508 in FIG. 14, in the driver setting priority mode will be described below with reference to a flowchart illustrated in FIG. 15.

In a state in which this setting process is started, the sheet size, the sheet orientation, and the sheet type of the printing sheet attribute information are all initialized (see Step S502). In starting the setting process, the CPU 107 sets values sampled out of the PDL data as the sheet size, the sheet orientation and the sheet type of the printing sheet attribute information in Steps S601. Next, the CPU 107 obtains sheet size information of the sheet placed on the manual feed tray 52 from the guide width sensors 54 and the length detection sensors 57 and 58 in Step S602. That is, Steps S503 and S602 are obtaining steps of obtaining information concerning the size and the type of the sheet related to the sheet support portion and the size of the sheet supported in the sheet support portion and detected by the size detection portion. Then, the CPU 107 determines whether the sheet is a regular size sheet as described with reference to FIG. 4 from the obtained sheet size information in Step S603. If the sheet is determined to be a regular size sheet, i.e., Yes in Step S603, the CPU 107 judges whether the determined regular size sheet coincides with the sheet size of the job sheet attribute information in Step S604.

In a case where the determined regular size does not coincide with the sheet size of the job sheet attribute information, i.e., No in Step S604, the CPU 107 changes the sheet size of the printing sheet attribute information to the determined regular size in Step S605 and finishes the setting process. The CPU 107 finishes the setting process in a case where the sheet size is determined not to be the regular size in Step S603 and also in a case where the regular size determined in Step S604 coincides with the sheet size of the job sheet attribute information.

The determinations in Steps S509 and S510 are carried out based on such setting of the printing sheet attribute information. That is, in a case where it is determined not to be the regular size in Step S603, the process does not advance to Step S605, so that they are always determined to be 'consistent' in Steps S509 and S510. That is, in a case where no regular sheet size is detected by the size detection portions 54, 57 and 58, the CPU 107 judges that it is possible to form an image on the sheet regardless of whether the sheet size and type included in the image forming job coincide with the size and type of the sheet related to the sheet support portion.

In a case where the regular size determined in Step S604 coincides with the sheet size in the job sheet attribute information in Step S604, the process does not advance to Step S605, so that it is always determined to be 'coincident' in Steps S509 and S510. That is, in a case where the sheet size included in the PDL job coincides with the sheet size detected by the size detection portions 54, 57 and 58, the CPU 107 judges that the image can be formed on the sheet regardless of whether the sheet size and type included in the image forming job coincide with the sheet size and type related to the sheet support portion.

Meanwhile, in a case where the determined regular size does not coincide with the sheet size in the job sheet attribute information in Step S604, the process advances to Step S605, so that it is always determined to be 'inconsistent' in Step S509. Then, a result of the sheet-support-portion conformity determination becomes NG in Step S306. In a case where a result of all of the sheet-support-portion conformity determinations of all of the sheet support portions to be retrieved is NG, the CPU 107 indicates an alarm on the display 103 in Step S308 and stops the image forming engine 50. That is, in the case where the sheet size included in the PDL job does not coincide with the sheet size detected by the size detection portions 54, 57 and 58, the CPU 107 controls so as to indicate the alarm on the display 103 and to stop the image forming engine 50. It is noted that the alarm may be what gives a notification to the user that the sheet size included in the PDL job does not coincide with the sheet size detected by the size detection portion. While the display 103 indicates such that "no sheet suitable for printing" in the present embodiment, the alarm may be also "please check sheet" or the like. It may be arranged such that the alarm is given by ringing a warning tone or by flickering light. It is also possible to arrange such that an alarm message is displayed after ringing the warning tone and a status checking button is pressed.

As described above, in the case where the regular size determined by the size detection portions 54, 57 and 58 is different from the sheet size set in the PDL job in the driver setting priority mode, the regular size determined to be a sheet size of the printing sheet attribute information is used. Therefore, even if the user erroneously places a sheet of a sheet size different from the sheet size specified in the PDL job on the manual feed tray 52, it is possible to halt the printing before the sheet is fed. This arrangement makes it possible to prevent or reduce a failure of an output image, so that a printing result as expected by the user may be obtained. Still further, because the user is informed of that the sheet size included in the PDL job does not coincide with the sheet size detected by the size detection portion, it is possible to urge the user to replace the sheet or to change the PDL job. That is, the image forming operation suitable for the sheet size of the sheet supported in the sheet support portion can be executed adequately while reducing the burden of the user of setting the sheet size.

Second Embodiment

The operation of the image forming apparatus 101 is switched depending on whether the obtained regular size coincides with the sheet size of the job sheet attribute information in the first embodiment. However, the user may want to execute printing even if the sheet sizes are inconsistent. For instance, the user may want to print on a sheet placed on the manual feed tray 52 without changing the setting of the job if image data is not interrupted.

Figure 15:
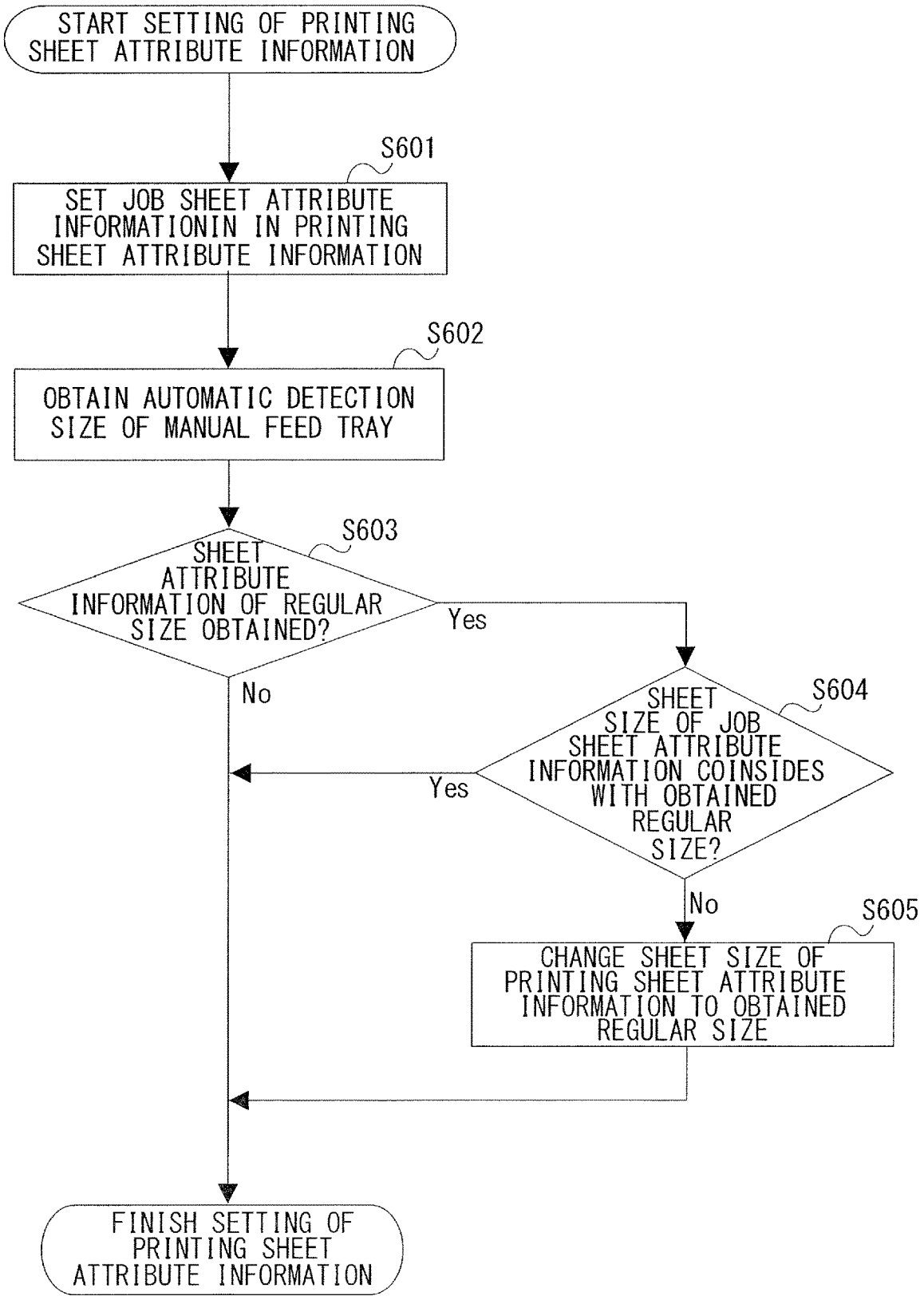
FIG. 15 is a flowchart illustrating a procedure of a setting process of printing sheet attribute information executed in the driver setting priority mode of a second embodiment.

In such a case, the condition in Step S604 in FIG. 15 may be changed as follows. At first, the condition is such that whether a size in the job sheet attribute information coincides with the regular size determined in Step S603 or with a similar sheet with the regular size. Here, the similar sheet refers to a sheet of a size similar to a predetermined regular size such as a LTR sheet to an A4 sheet and an 11×17 inch sheet to an A3 sheet. It is noted that these corresponding relations of the regular size and the similar size are stored in the storage portion such as the ROM 112, the RAM 113, the HDD110, and the EEPROM 111. That is, the storage portion stores information concerning the similar size related to the predetermined regular size. In a case when such sheet is used, image data is printed on the sheet without interruption and the user can obtain a printed without replacing the sheet in many cases.

Still further, another condition may be set such that whether the size of the job sheet attribute information is smaller than the regular size determined in Step S603. That is, a first condition is set such that the sheet size included in the PDL job is smaller than the sheet size detected by the size detection portions 54, 57 and 58. A second condition is set such that the sheet type included in the PDL job coincides with the sheet type as the printing sheet attribute information stored in the EEPROM 111. In a case where these first and second conditions are met, the CPU 107 controls the image forming engine 50 so as to form the image on the sheet. In such a case, because the image data is smaller than the sheet placed on the manual feed tray 52, the user can obtain a printed matter in which no data is missed. In a case where either one of these first and second conditions is not met, the CPU 107 halts the image forming engine 50.

Third Embodiment

The obtained regular size is compared with the sheet size of the job sheet attribute information to determine whether the sheet should be fed in the first and second embodiments described above. However, the user may want to print on the sheet placed on the manual feed tray 52 in any case.

Normally, sheet size information used in a conveyance operation is a sheet size of the printing sheet attribute information. For instance, if the sheet size of the printing sheet attribute information is an A4 size, the conveyance operation is carried out by assuming the A4 size. Specifically, the sheet conveyance portion 69 composed of the pickup roller 61, the registration roller 62, the discharge roller 63 and the conveyance rollers 65 through are rotated by the size of A4 to convey the sheet. Thereby, the sheet is discharged without stopping within the printer unit 105. That is, the CPU 107 controls the conveyance operation by the sheet conveyance portion 69 by using the sheet size in the printing sheet attribute information. In a case of conveying an A4 size sheet, the CPU 107 rotates the pickup roller and others just to be able to convey the A4 sheet size, and in a case of conveying an A3 size sheet larger than the A4 size sheet, the CPU 107 rotates the pickup roller and others just to be able to convey the A3 sheet size. Accordingly, a rotation amount of the pickup roller and others in conveying the A4 size sheet is smaller than that in conveying the A3 size sheet. Thus, it becomes unnecessary to rotate the pickup roller and others unnecessarily and wear of the pickup roller and others can be reduced by rotating the pickup roller and others corresponding to the sheet size. It is noted that a known conveyance belt and a conveyance claw, other than the rollers, are applicable as the sheet conveyance portion 69.

However, in the case where the sheet size of the sheet placed on the manual feed tray 52 is different from the sheet size specified in the PDL job, the conveyance operation is carried out corresponding to the sheet size specified in the PDL job in the driver setting priority mode. That is, in a case where the A4 size is specified in the PDL job even if the sheet size of the sheet actually placed on the manual feed tray 52 is the A3 size, the sheet conveyance portion 69 rotates by the size of the A4 sheet, so that the conveyance of the sheet stops on the way.

In such a case, it is possible to complete the printing process without halting the conveyance of the sheet by using the regular size determined from the detection results of the guide width sensors 54 and the length detection sensors 57 and 58 as the sheet size information used in the conveyance operation.

Figure 16:
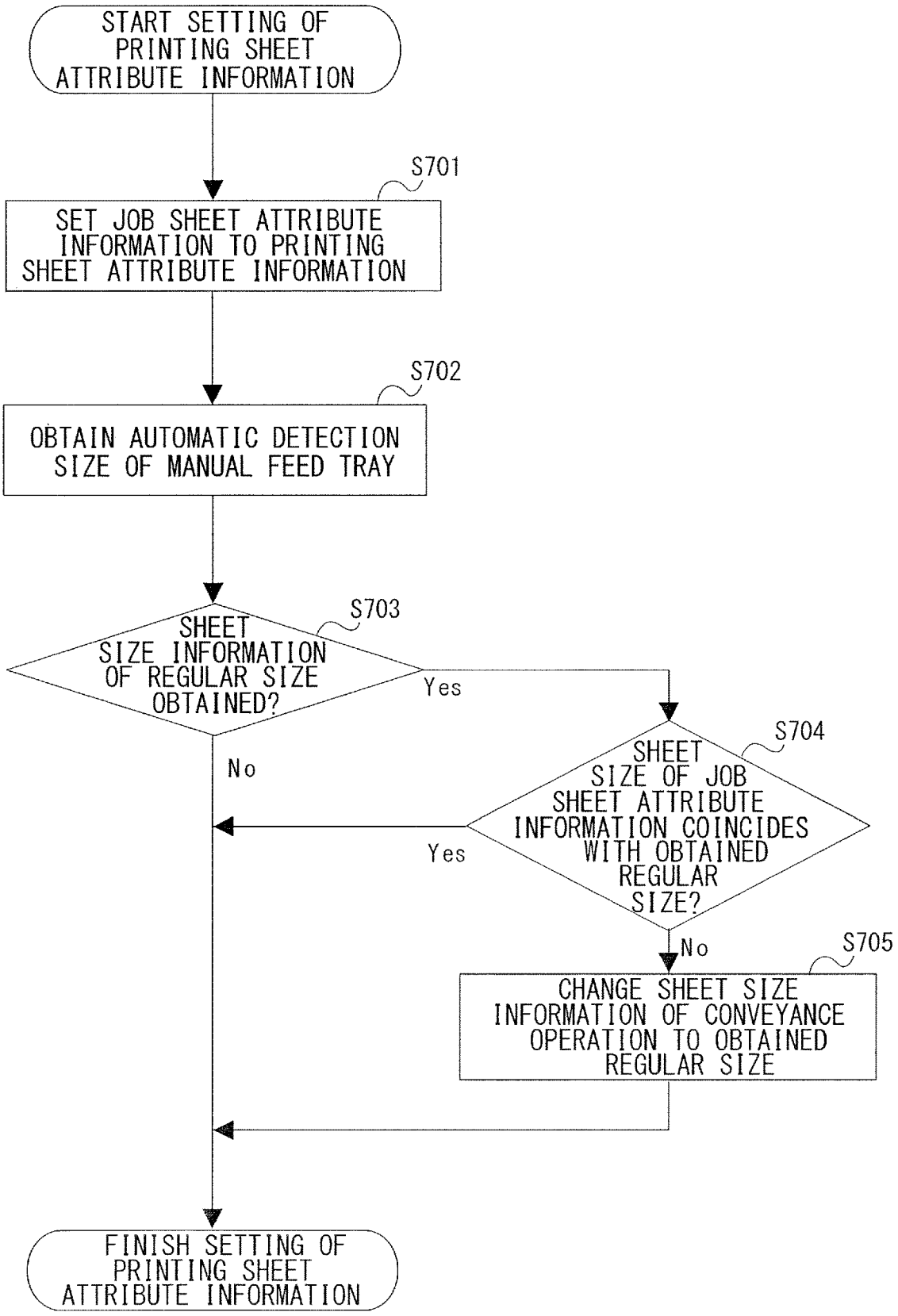
FIG. 16 is a flowchart illustrating a procedure of the printing sheet attribute information setting process executed in a driver setting priority mode of a third embodiment.

FIG. 16 is a flowchart illustrating a setting process (Step S508 in FIG. 14) of the printing sheet attribute information in the driver setting priority mode. It is noted that because Steps S701 through S704 in FIG. 16 are the same with Steps S601 through S604 in FIG. 15, their description will be omitted here.

In the case where the regular size determined in Step S704 does not coincide with the sheet size of the job sheet attribute information, the CPU 107 changes the sheet size information of the conveyance operation to the determined regular size in Step S705 and finishes the setting process. Then, in a case where the process of Step S705 is executed, it is always determined to be 'coincident' in Steps S509 and S510 in FIG. 15 in the present embodiment. That is, in the case where the sheet size included in the PDL job does not coincide with the regular size detected by the size detection portions 54, 57 and 58, the CPU 107 executes the printing operation after changing the sheet size of the conveyance operation to the determined regular size.

This arrangement makes it possible to carry out the printing operation without halting the conveyance on the way upon responding to a need of the user who wants to print on the sheet placed on the manual feed tray 52 in any case.

Fourth Embodiment

In the third embodiment, the conveyance operation of the sheet conveyance portion 69 is controlled corresponding to the regular sheet size even in a case where the regular sheet size detected by the guide width sensors 54 and the length detection sensors 57 and 58 do not coincide with the sheet size of the job sheet attribute information. However, in a case where the user fails to firmly adjust the guide width sensors 54 with the sheet placed on the manual feed tray 52 for example, the guide width sensors 54 and the length detection sensors 57 and 58 may detect the size erroneously. In such a case, the sheet may cause a jam and the user may want to carry out the printing operation more reliably without causing any jam.

Figure 17:
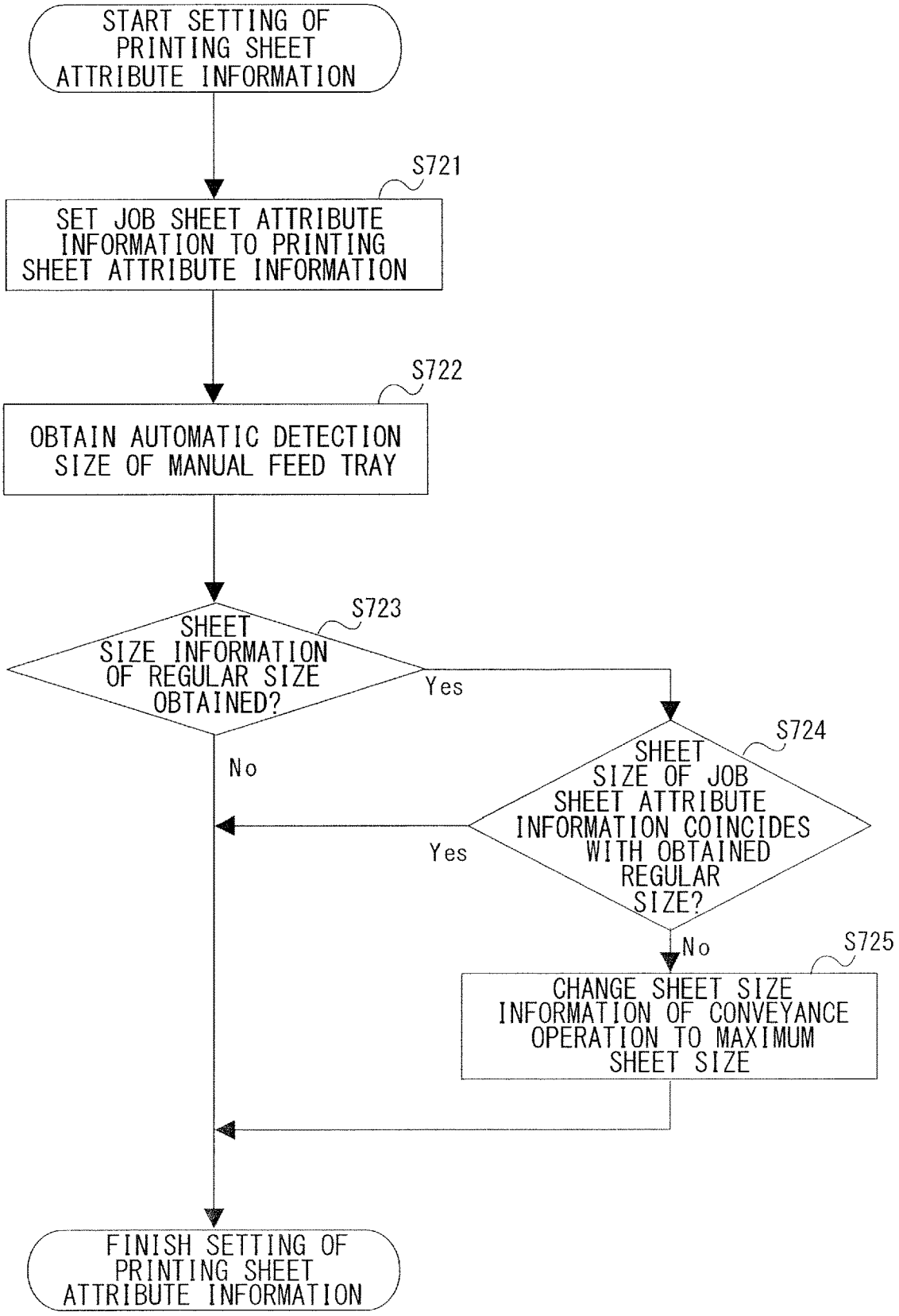
FIG. 17 is a flowchart illustrating a procedure of a printing sheet-attribute-information setting process of a fourth embodiment.

Then, according to the present embodiment, instead of the flowchart as illustrated in FIG. 16, the CPU 107 executes the printing sheet attribute information setting process along a flowchart illustrated in FIG. 17. It is noted that because Steps S721 through S724 are same with Steps S701 through S704 in FIG. 16, their description will be omitted here.

In a case where the determined regular size does not coincide with the sheet size of the sheet attribute information, i.e., No in Step S724, the CPU 107 changes the sheet size information of the conveyance operation to a maximum sheet size supported by the image forming apparatus 101 in Step S725. Then, the CPU 107 finishes the printing sheet attribute information setting process. The maximum sheet size supported by the image forming apparatus 101 is maximum size among sheet sizes usable as a product specification in the image forming apparatus 101. Then, according to the present embodiment, in a case where the process of Step S725 is executed, it is always determined to 'coincide' in Steps S509 and S510 in the flowchart of FIG. 15. That is, in a case where the sheet size included in the PDL job does not coincide with the regular size detected by the size detection portions (54, 57, and 58), the CPU 107 executes the printing operation after changing the sheet size information of the conveyance operation to the maximum sheet size.

This arrangement makes it possible to carry out the printing operation while responding to the request of the user wanting to print on the sheet placed on the manual feed tray 52 by any means and while preventing a jam more reliably.

Fifth Embodiment

Figure 18:
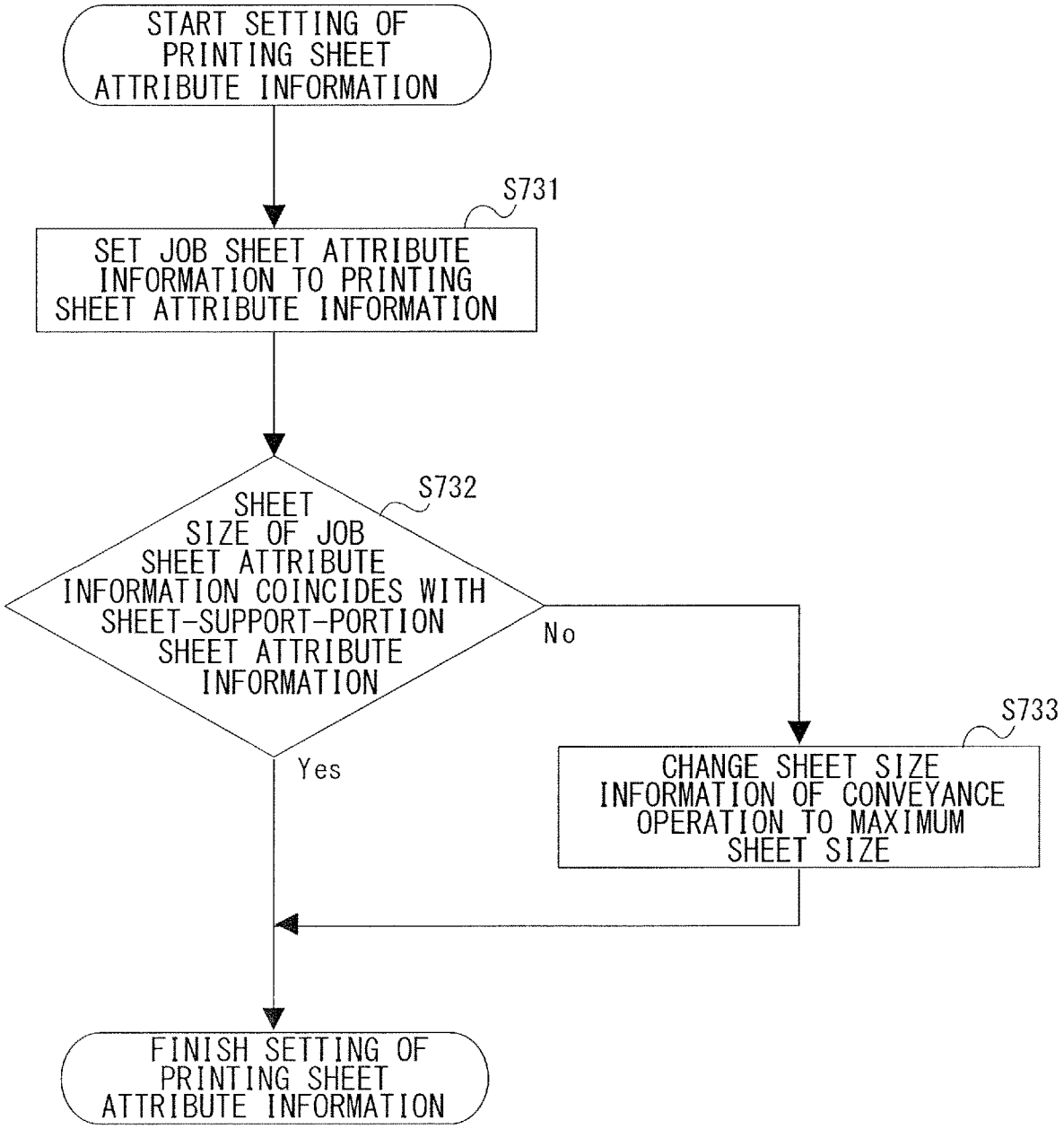
FIG. 18 is a flowchart illustrating a procedure of a printing sheet-attribute-information setting process of a fifth embodiment.

While the control of the conveyance operation in the image forming apparatus provided with the guide width sensors 54 and the length detection sensors 57 and 58 has been described in the fourth embodiment, there is also an image forming apparatus including no such guide width sensors 54 and length detection sensors 57. Then, according to the present embodiment, the CPU 107 executes a printing sheet-attribute-information setting process along a flowchart as illustrated in FIG. 18 instead of the flowchart as illustrated in and described with FIG. 17. It is noted that because Step S731 in FIG. 18 is the same with Step S721 in FIG. 17, its description will be omitted here.

The CPU 107 judges whether the sheet size of the sheet support portion sheet attribute information stored in the EEPROM 111 coincides with the sheet size of the job sheet attribute information in Step S732. In a case where the sheet support portion designated as an object of retrieval is the manual feed tray 52, the sheet size of the sheet support portion sheet-attribute-information is a size of a sheet stored in the EEPROM 111 and associated with the manual feed tray 52.

In a case where the sheet size of the sheet support portion sheet-attribute-information does not coincide with the sheet size of the job sheet attribute information, i.e., No in Step S732, the CPU 107 changes the sheet size information of the conveyance operation to the usable maximum sheet size in Step S733 and finishes the process. In a case where the sheet size of the sheet support portion sheet-attribute-information coincides with the sheet size of the job sheet attribute information, i.e., Yes in Step S732, the CPU 107 finishes the process while keeping and without specifically changing the sheet size information of the conveyance operation as the job sheet attribute information.

As described above, even in a case where there is no mechanism for detecting the size of the sheet placed on the sheet support portion of the image forming apparatus 101, the CPU 107 compares the sheet support portion sheet-attribute-information with the sheet size of the job sheet attribute information. Then, even in a case where they do not coincide, it is possible to prevent a jam from occurring by setting the sheet size information of the conveyance operation made by the sheet conveyance portion 69 to the maximum sheet size. This arrangement makes it possible to obtain a printing result as expected by the user.

It is noted that the method for setting the sheet size information of the conveyance operation described in the third through fifth embodiments may be configured so as to be switchable from the operation portion 104 in advance. This arrangement makes it possible to freely control the conveyance operation of the sheet conveyance portion 69 while permitting the user to consider a printing speed and a jam avoiding performance.

Sixth Embodiment

What kind of operation is needed is different depending on a user after comparing the regular sheet size determined on the manual feed tray 52 with the sheet size of the job sheet attribute information described in the first through third embodiment. To that end, a method for switching operational conditions per user will be described below.

Figure 19:
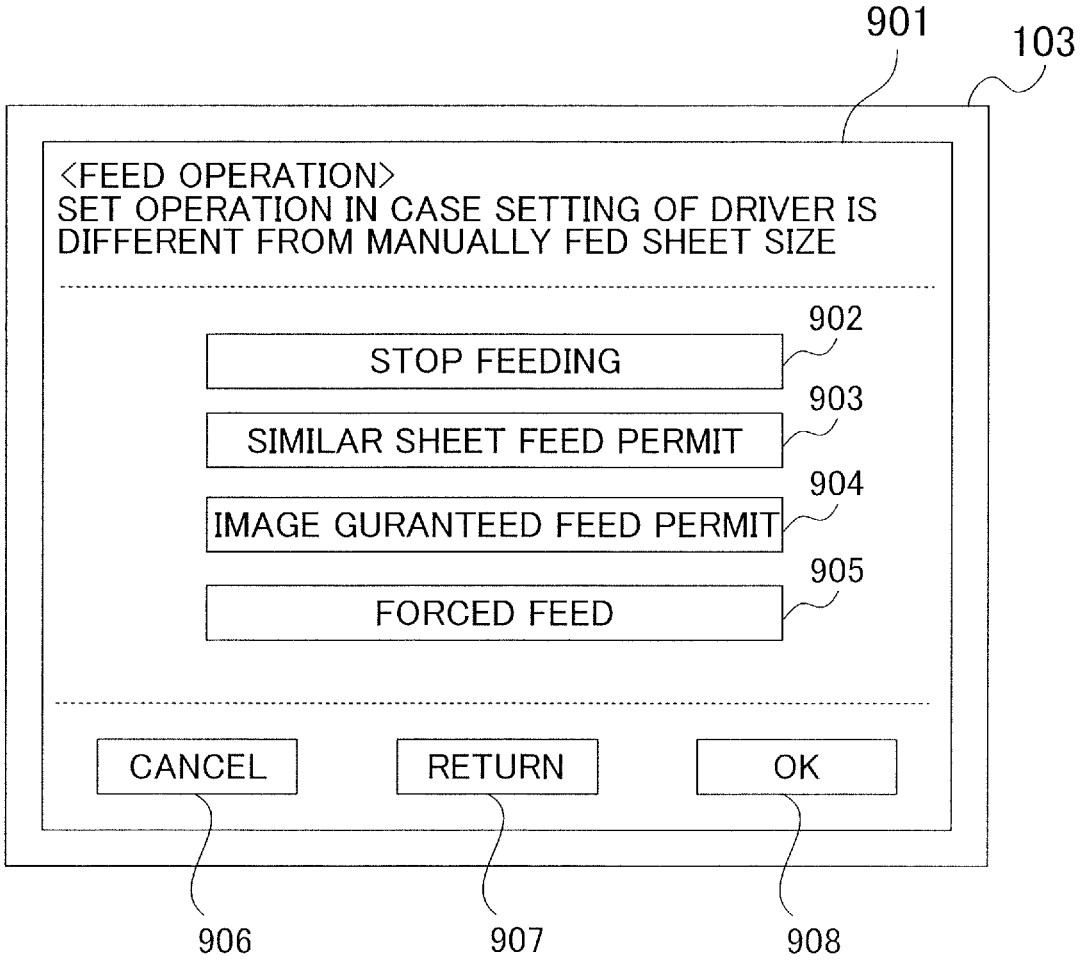
FIG. 19 illustrates a selection screen of a sixth embodiment.

FIG. 19 is an image illustrating a selection screen 901 on which the user can select the operation to be taken after the comparison of the regular sheet size and the sheet size of the job sheet attribute information. As illustrated in FIG. 19, the selection screen 901 is displayed on the display 103 in a case when the user turns ON the driver priority setting on the setting changing screen 401. The selection screen 901 displays a 'feed stop' key 902, a 'similar sheet feed permit' key 903, an 'image guaranteed feed permit' key 904, a 'forced feed' key 905, a 'cancel' key 906, a 'return' key 907 and an 'OK' key 908.

The user selects the 'feed stop' key 902 in a case where the user wants to stop feeding a sheet when the determined regular sheet size does not coincide with the sheet size of the job sheet attribute information as described in the first embodiment. The user selects the 'similar sheet feed permit' key 903 in comparing the determined regular sheet size with the sheet size of the job sheet attribute information to its similar size as described in the second embodiment and in stopping to feed a sheet when they do not coincide with each other.

The user selects the 'image guaranteed feed permit' key 904 in stopping to feed a sheet when the size of the job sheet attribute information is larger than the determined regular size as described in the second embodiment. The user selects the 'forced sheet feed' key 905 in continuing the operation without stopping to feed a sheet even when the determined regular size is different from the sheet size set in the job as described in the third embodiment.

If the 'OK' key 908 is pressed in a state in which any one of the keys described above is selected, the condition selected by the user is stored in the EEPROM 111 as a setting of a sheet feed operation in the driver setting priority mode. In a case where the 'cancel' key 906 or the 'return' key 907 is pressed, the setting of the sheet feed operation in the driver setting priority mode is not changed.

Seventh Embodiment

The operations in the case where the regular size is determined have been described in the first through fourth embodiments and the sixth embodiment. However, as described with reference to FIG. 4, there exists an irregular size which is not applicable to any regular sizes according to the detected size. There also exists an image forming apparatus having no guide width sensors 54 and the length detection sensors 57 and 58 on the manual feed tray 52. Even in such a case, it is possible to find a size of a sheet by using a sheet detecting sensor 81 by feeding and conveying the sheet as described with reference to FIG. 5. In such a case, it is possible to determine the sheet size by conveying a first sheet and to prevent printing unwanted by the user by switching the sheet feed operation whether a second sheet should be fed.

Figure 20:
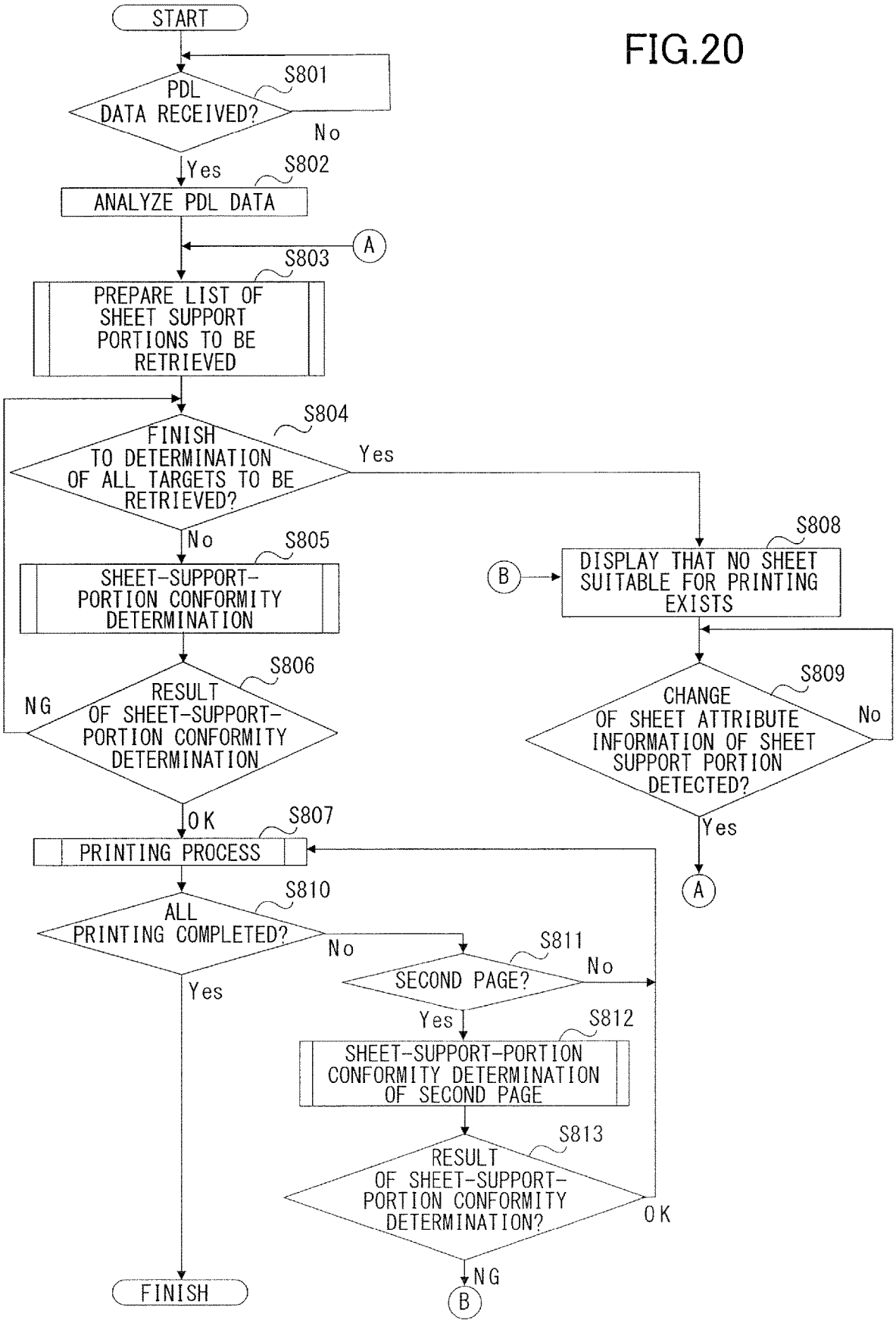
FIG. 20 is a flowchart illustrating a procedure of an execution process of a PDL job of a seventh embodiment.

FIG. 20 is a flowchart illustrating a procedure of the execution process in executing the PDL job. It is noted that because Steps S801 through S809 in FIG. 20 are the same with Steps S301 through S309 in FIG. 12, their description will be omitted here. When the printing process of the first sheet is carried in Step S807, the CPU 107 determines whether printing of all sheets has been completed in Step S810. In a case where the CPU 107 determines that printing of all of the sheets has been completed, i.e., Yes in Step S810, the CPU 107 finishes the execution process of the PDL job.

Meanwhile, in a case where there exists printing data to be printed in Step S810, the CPU 107 determines whether a printing page to be processed next is a second page in Step S811. In a case where the CPU 107 determines that it is the second page, i.e., Yes in Step S811, the CPU 107 carries out a sheet-support-portion conformity determination of the second page in Step S812.

In a case where it is determined to be OK, i.e., conformable, by the sheet-support-portion conformity determination of the second page in Step S813, the CPU 107 executes the printing process in Step S807. In a case where it is determined to be NG, i.e., unconformable, in the sheet-support-portion conformity determination of the second page in Step S813, the CPU 107 advances the process to Step S808. The process in Step S808 is the same with the control in Step S308 in the first embodiment, so that a description thereof will be omitted here.

Figure 21:
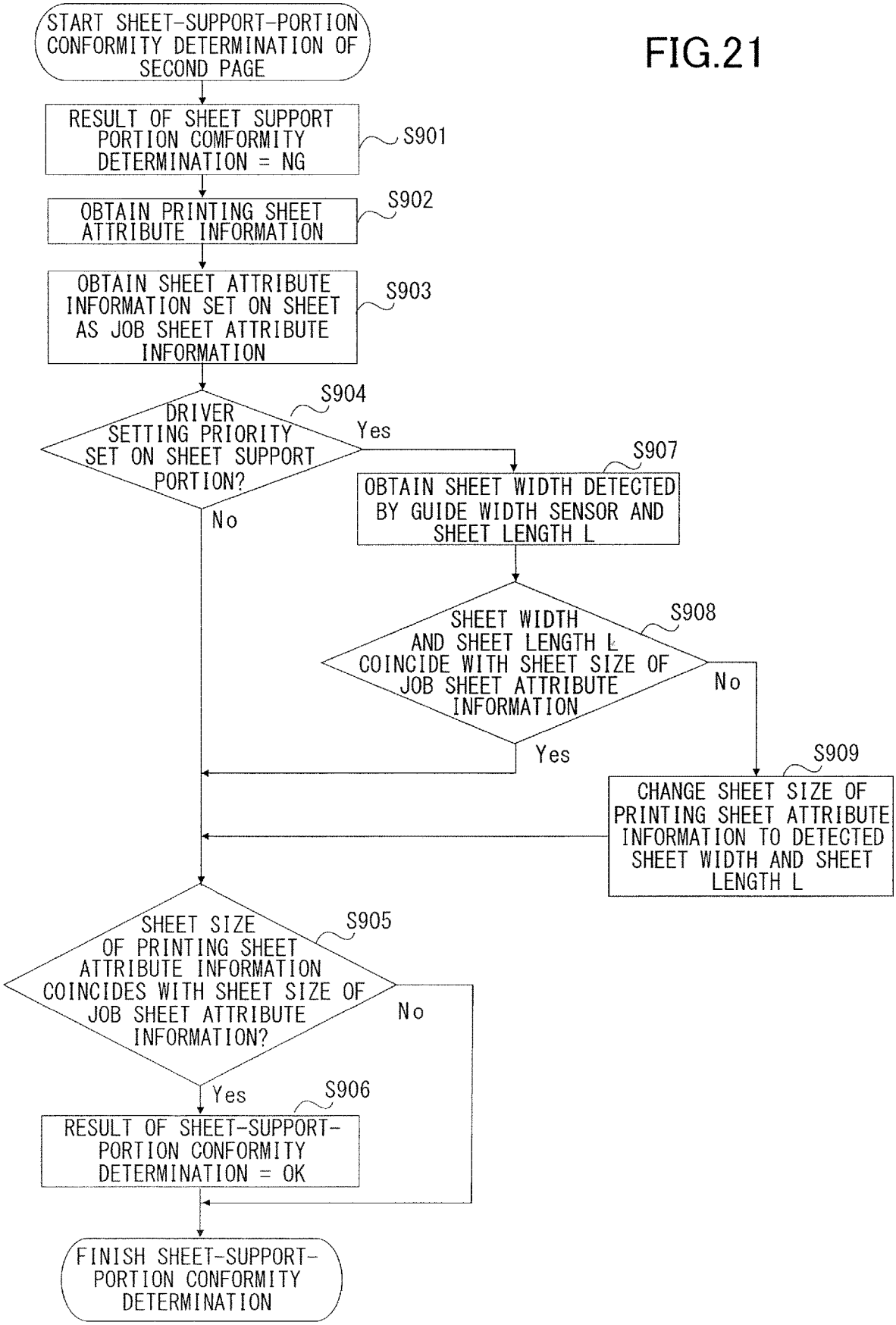
FIG. 21 is a flowchart illustrating a procedure of a sheet-support-portion conformity determination process of a second page.

Processing contents in carrying out the sheet-support-portion conformity determination of the second page, i.e., the Step S812 in FIG. 20, in the PDL execution process described above will be described along a flowchart in FIG. 21. At first, the CPU 107 sets a variable representing a determination result of the sheet-support-portion conformity determination of the second page to 'NG' in Step S901 and obtain the printing sheet attribute information which has been already set in Step S805 in Step S902.

Next, the CPU 107 obtains the sheet attribute information included in the PDL job as ' job sheet attribute information' in Step S903 and obtains setting information whether the driver setting priority function is enabled or disabled from the EEPROM 111 in Step S904. In a case where the driver setting priority function is disabled (No), i.e., Disabled in Step S904, the CPU 107 advances the process to Step S905.

In a case where the driver setting priority function is enabled (Yes), i.e., Enabled in Step S904, the CPU 107 obtains a sheet width detected by the guide width sensors 54 and a sheet length L calculated in conveying the first sheet as described with reference to FIG. 5 in Step S907. Then, the CPU 107 determines whether the sheet width and the sheet length L coincide with the sheet size of the job sheet attribute information in Step S908. In a case where they coincide with each other, the CPU 107 advances the process to Step S905. In a case where they do not coincide with each other, the CPU 107 changes the sheet size of the printing sheet attribute information to the sheet width and the sheet length L in Step S909 and then advances the process to Step S905.

In Step S905, the CPU 107 determines whether the sheet size of the printing sheet attribute information coincides with the sheet size of the job sheet attribute information. In a case where it is determined that the sheet width and the sheet length L coincide with the sheet size of the job sheet attribute information at this time, the CPU 107 does not advance the process to Step S909, so that it is always determined to be 'coincident' in Step S905. Meanwhile, in a case where it is determined that the sheet width and the sheet length L do not coincide with the sheet size of the job sheet attribute information in Step S908, the CPU 107 advances the process to Step S909, so that they are always determined to be 'inconsistent' in Step S905.

In a case where the determination result of Step S905 is 'inconsistent', i.e., No in Step S905, the CPU 107 judges that it is impossible to execute the PDL job, returns 'NG', i.e., an initial value, as a determination result and finishes the process. Meanwhile in a case where the determination result of Step S905 is 'consistent', i.e., Yes in Step S905, the CPU 107 returns 'OK' as a result of the sheet-support-portion conformity determination of the second page and finishes the process in Step S906.

As described above, the CPU 107 detects the sheet length L by the sheet detecting sensor 81 when the first sheet is conveyed and determines whether the sheet sizes coincide with each other by using the sheet width detected by the guide width sensors 54 and the sheet length L in conveying the second sheet. This arrangement makes it possible to stop feeding before feeding the second sheet even if the user erroneously places a sheet having a different size from an assumed size on the manual feed tray 52.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-203394, filed on Oct. 17, 2016, and Japanese Patent Application No. 2017-173438, filed on Sep. 8, 2017, which are hereby incorporated by reference herein in their entirety.

What is claimed is:

1. An image forming apparatus, comprising:

a sheet support portion configured to support a sheet;

an image forming portion configured to form an image on the sheet fed from the sheet support portion;

a storage portion configured to store information concerning a sheet size which is inputted through an operation portion associated with the sheet support portion;

a notification portion configured to give notification;

a size detection portion configured to detect a sheet size of the sheet supported on the sheet support portion; and a processor configured to execute one of a plurality of modes including a first mode and a second mode in a case where an image forming job is inputted, the first mode being a mode where the processor controls the image forming portion to form an image on the sheet only if a sheet size included in the image forming job is consistent with the sheet size stored in the storage portion, the second mode being a mode where the processor controls the image forming portion to form the image on the sheet, based on detection information of the size detection portion, wherein the processor controls, in the second mode, the image forming portion so as to form the image on the sheet in a case where the size detection portion detects one of regular sheet sizes and where the sheet size included in the image forming job is consistent with the sheet size detected by the size detection portion, and controls, in the second mode, the notification portion so as to give notification in a case where the size detection portion detects one of regular sheet sizes and where the sheet size included in the image forming job is inconsistent with the sheet size detected by the size detection portion.

2. The image forming apparatus according to claim 1, wherein the storage portion is configured to store information concerning a sheet type related to the sheet support portion, and the processor controls, in the second mode, the image forming portion so as to form the image on the sheet regardless of whether a sheet type included in the image forming job is consistent with the sheet type stored in the storage portion or not in a case where the size detection portion detects one of regular sheet sizes and where the sheet size included in the image forming job is consistent with the sheet size detected by the size detection portion.

3. The image forming apparatus according to claim 1, wherein the size detection portion includes a sheet width detection portion provided on the sheet support portion and configured to detect a sheet width in a direction orthogonal to a sheet conveyance direction, and a sheet length detecting portion provided on the sheet support portion and configured to detect a sheet length in the sheet conveyance direction.

4. The image forming apparatus according to claim 1, wherein the size detection portion includes a sheet width detection portion provided on the sheet support portion and configured to detect a sheet width in a direction orthogonal to a sheet conveyance direction, and a conveyed sheet length detection portion configured to detect a sheet length in the sheet conveyance direction of the sheet being conveyed, and the processor obtains, in the second mode, a sheet length in the sheet conveyance direction by the conveyed sheet length detection portion in conveying a first sheet, and uses the sheet length obtained in conveying the first sheet and the sheet width detected by the sheet width detection portion as a sheet size of a second sheet detected by the size detection portion in conveying the second sheet.

5. The image forming apparatus according to claim 1, wherein the storage portion is configured to store information concerning a sheet type related to the sheet support portion, and the processor controls, in the first mode, the image forming portion so as to form an image on the sheet in a case where a sheet size and type included in the image forming job are consistent with the sheet size and type stored in the storage portion.

6. The image forming apparatus according to claim 1, wherein the storage portion is configured to store information concerning a sheet type related to the sheet support portion, and the processor controls, in the second mode, the image forming portion so as to form an image on the sheet regardless of whether the sheet size and type included in the image forming job is consistent with the sheet size and type stored in the storage portion or not in a case where no regular size sheet is detected by the size detection portion.

7. The image forming apparatus according to claim 1, wherein the storage portion is configured to store information concerning a similar size associated with a predetermined regular size, and the processor controls, in the second mode, the image forming portion so as to form an image on the sheet in a case where the size detection portion detects one of regular sheet sizes and where the sheet size included in the image forming job is consistent with the sheet size detected by the size detection portion or the similar size thereof, and controls the notification portion so as to give notification in a case where the size detection portion detects one of regular sheet sizes and where the sheet size included in the image forming job is inconsistent with the sheet size detected by the size detection portion or with the similar size thereof.

8. An image forming apparatus, comprising:

a sheet support portion configured to support a sheet;

an image forming portion configured to form an image on the sheet fed from the sheet support portion;

a storage portion configured to store information concerning a sheet size which is inputted through an operation portion associated with the sheet support portion;

a notification portion configured to give notification;

a size detection portion configured to detect a sheet size of the sheet supported by the sheet support portion; and a processor configured to execute one of a plurality of modes including a first mode and a second mode in a case where an image forming job is inputted, the first mode being a mode where the processor controls the image forming portion to form an image on the sheet only if a sheet size included in the image forming job is consistent with the sheet size stored in the storage portion, a second mode being a mode where the processor controls the image forming portion to form the image on the sheet, based on the detection information of the size detection portion, wherein the processor controls, in the second mode, the image forming portion so as to form an image on the sheet in a case where the size detection portion detects one of regular sheet sizes and where the sheet size included in the image forming job is less than or equal to the sheet size detected by the size detection portion, and controls, in the second mode, the notification portion so as to give notification in a case where the size detection portion detects one of regular sheet sizes and where the sheet size included in the image forming job is larger than the sheet size detected by the size detection portion.

9. The image forming apparatus according to claim 8, wherein the size detection portion includes a sheet width detection portion provided on the sheet support portion and configured to detect a sheet width in a direction orthogonal to a sheet conveyance direction, and a sheet length detection portion provided on the sheet support portion and configured to detect a sheet length in the sheet conveyance direction.

10. The image forming apparatus according to claim 8, wherein the size detection portion includes a sheet width detection portion provided on the sheet support portion and configured to detect a sheet width in the direction orthogonal to the sheet conveyance direction and a conveyed sheet length detection portion configured to detect a sheet length in the sheet conveyance direction of a sheet being conveyed, and the processor obtains, in the second mode, the sheet length in the sheet conveyance direction by the conveyed sheet length detection portion in conveying a first sheet, and uses the sheet length obtained in conveying the first sheet and the sheet width detected by the sheet width detection portion as a sheet size of a second sheet detected by the size detection portion in conveying the second sheet.

11. The image forming apparatus according to claim 8, wherein the storage portion is configured to store information concerning a sheet type related to the sheet support portion, and the processor controls, in the first mode, the image forming portion so as to form an image on the sheet in a case where a sheet size and type included in the image forming job are consistent with the size and type stored in the storage portion.

12. The image forming apparatus according to claim 8, wherein the storage portion is configured to store information concerning a sheet type related to the sheet support portion, and the processor controls, in the second mode, the image forming portion so as to form an image on the sheet regardless of whether the sheet size and type included in the image forming job is consistent with the sheet size and type stored in the storage portion or not in a case where no regular size sheet is detected by the size detection portion.

13. An image forming apparatus, comprising:

a sheet support portion configured to support a sheet;

an image forming portion configured to form an image on the sheet fed from the sheet support portion;

a sheet conveyance portion configured to convey the sheet;

a storage portion configured to store information concerning a sheet size which is inputted through an operation portion associated with the sheet support portion;

a size detection portion configured to detect a sheet size of the sheet supported by the sheet support portion; and a processor configured to execute one of a plurality of modes including a first mode and a second mode in a case where an image forming job is inputted, the first mode being a mode where the processor controls the image forming portion to form an image on the sheet only if a sheet size included in the image forming job is consistent with the sheet size stored in the storage portion, a second mode being a mode where the processor is capable of controlling the image forming portion to form the image on the sheet even if the sheet size included in the image forming job is inconsistent with the sheet size stored in the storage portion, wherein the processor controls, in the second mode, the image forming portion so as to form an image on the sheet in a case where the size detection portion detects one of regular sheet sizes and where the sheet size included in the image forming job is consistent with the sheet size detected by the size detection portion, and the processor controls, in the second mode, a conveyance operation by the sheet conveyance portion corresponding to the sheet size detected by the size detection portion and controls the image forming portion to form an image on the sheet in a case where the size detection portion detects one of regular sheet sizes and where the sheet size included in the image forming job is inconsistent with the sheet size detected by the size detection portion.

14. The image forming apparatus according to claim 13, wherein the size detection portion includes a sheet width detection portion provided on the sheet support portion and configured to detect a sheet width in a direction orthogonal to a sheet conveyance direction, and a sheet length detection portion provided on the sheet support portion and configured to detect a sheet length in the sheet conveyance direction.

15. The image forming apparatus according to claim 13, wherein the size detection portion includes a sheet width detection portion provided on the sheet support portion and configured to detect a sheet width in a direction orthogonal to a sheet conveyance direction and a conveyed sheet length detection portion configured to detect a sheet length in the sheet conveyance direction of a sheet being conveyed, and the processor obtains, in the second mode, the sheet length in the sheet conveyance direction by the conveyed sheet length detection portion in conveying a first sheet, and uses the sheet length obtained in conveying the first sheet and the sheet width detected by the sheet width detection portion as a sheet size of a second sheet detected by the size detection portion in conveying the second sheet.

16. The image forming apparatus according to claim 13, wherein the storage portion is configured to store information concerning a sheet type related to the sheet support portion, and the processor controls, in the first mode, the image forming portion to form an image on the sheet in a case where a sheet size and type included in the image forming job are consistent with the size and type stored in the storage portion.

17. The image forming apparatus according to claim 13, wherein the storage portion is configured to store information concerning a sheet type related with the sheet support portion, and the processor controls, in the second mode, the image forming portion to form an image on the sheet regardless of whether the sheet size and type included in the image forming job is consistent with the sheet size and type stored in the storage portion or not in a case where no regular size sheet is detected by the size detection portion.

18. An image forming apparatus, comprising:

a sheet support portion configured to support a sheet;

an image forming portion configured to form an image on the sheet fed from the sheet support portion;

a sheet conveyance portion configured to convey the sheet;

a storage portion configured to store information concerning a sheet size which is inputted through an operation portion associated with the sheet support portion;

a size detection portion configured to detect a sheet size of the sheet supported by the sheet support portion; and a processor configured to execute one of a plurality of modes including a first mode and a second mode in a case where an image forming job is inputted, the first mode being a mode where the processor controls the image forming portion to form an image on the sheet only if a sheet size included in the image forming job is consistent with the sheet size stored in the storage portion, a second mode being a mode where the processor is capable of controlling the image forming portion to form the image on the sheet even if the sheet size included in the image forming job is inconsistent with the sheet size stored in the storage portion, wherein the processor controls, in the second mode, the image forming portion so as to form an image on the sheet in a case where the size detection portion detects one of regular sheet sizes and where the sheet size included in the image forming job is consistent with the sheet size detected by the size detection portion, and the processor controls, in the second mode, a conveyance operation by the sheet conveyance portion corresponding to a maximum sheet size supported by the image forming apparatus and controls the image forming portion to form an image on the sheet in a case where the size detection portion detects one of regular sheet sizes and where the sheet size included in the image forming job is inconsistent with the sheet size detected by the size detection portion.

19. The image forming apparatus according to claim 18, wherein the size detection portion includes a sheet width detection portion provided on the sheet support portion and configured to detect a sheet width in a direction orthogonal to a sheet conveyance direction, and a sheet length detection portion provided on the sheet support portion and configured to detect a sheet length in the sheet conveyance direction.

20. The image forming apparatus according to claim 18, wherein the size detection portion includes a sheet width detection portion provided on the sheet support portion and configured to detect a sheet width in a direction orthogonal to a sheet conveyance direction and a conveyed sheet length detection portion configured to detect a sheet length in the sheet conveyance direction of a sheet being conveyed, and the processor obtains, in the second mode, the sheet length in the sheet conveyance direction by the conveyed sheet length detection portion in conveying a first sheet, and uses the sheet length obtained in conveying the first sheet and the sheet width detected by the sheet width detection portion as a sheet size of a second sheet detected by the size detection portion in conveying the second sheet.

21. The image forming apparatus according to claim 18, wherein the storage portion is configured to store information concerning a sheet type related to the sheet support portion, and the processor controls, in the first mode, the image forming portion to form an image on the sheet in a case where a sheet size and type included in the image forming job are consistent with the size and type stored in the storage portion.

22. The image forming apparatus according to claim 18, wherein the storage portion is configured to store information concerning a sheet type related with the sheet support portion, and the processor controls, in the second mode, the image forming portion to form an image on the sheet regardless whether the sheet size and type included in the image forming job is consistent with the sheet size and type stored in the storage portion or not in a case where no regular size sheet is detected by the size detection portion.

23. An image forming apparatus, comprising:

a sheet support portion configured to support a sheet;

an image forming portion configured to form an image on the sheet fed from the sheet support portion;

a sheet conveyance portion configured to convey the sheet;

a storage portion configured to store information concerning a sheet size which is inputted through an operation portion in associated with the sheet support portion; and a processor configured to execute one of a plurality of modes including a first mode and a second mode in a case where an image forming job is inputted, the first mode being a mode where the processor controls the image forming portion to form an image on the sheet only if a sheet size included in the image forming job is consistent with the sheet size stored in the storage portion, a second mode being a mode where the processor is capable of controlling the image forming portion to form the image on the sheet even if the sheet size included in the image forming job is inconsistent with the sheet size stored in the storage portion, wherein the processor controls, in the second mode, the image forming portion so as to form an image on the sheet in a case where the sheet size included in the image forming job is consistent with the sheet size stored in the storage portion, and the processor controls, in the second mode, a conveyance operation by the sheet conveyance portion corresponding to a maximum sheet size supported by the image forming apparatus and controls the image forming portion to form an image on the sheet in a case where the sheet size included in the image forming job is inconsistent with the sheet size stored in the storage portion.

24. The image forming apparatus according to claim 23, wherein the storage portion is configured to store information concerning a sheet type related to the sheet support portion, and the processor controls, in the first mode, the image forming portion so as to form an image on the sheet in a case where a sheet size and type included in the image forming job are consistent with the sheet size and type stored in the storage portion.

* * * * *